US010564564B2

(12) United States Patent
Mandai

(10) Patent No.: US 10,564,564 B2
(45) Date of Patent: Feb. 18, 2020

(54) IMAGE FORMING APPARATUS AND METHOD FOR CONTROLLING IMAGE FORMING APPARATUS

(71) Applicant: KONICA MINOLTA, INC., Chiyoda-ku, Tokyo (JP)

(72) Inventor: Yuusuke Mandai, Kyoto (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/184,881

(22) Filed: Nov. 8, 2018

(65) Prior Publication Data

US 2019/0146369 A1 May 16, 2019

(30) Foreign Application Priority Data

Nov. 10, 2017 (JP) ..... 2017-217066

(51) Int. Cl.
*G03G 15/02* (2006.01)
*G03G 15/00* (2006.01)

(52) U.S. Cl.
CPC ..... *G03G 15/0275* (2013.01); *G03G 15/0266* (2013.01); *G03G 15/5033* (2013.01); *G03G 15/5037* (2013.01); *G03G 15/553* (2013.01)

(58) Field of Classification Search
CPC ..... G03G 15/0266; G03G 15/0285; G03G 15/5033; G03G 15/5037; G03G 15/553
See application file for complete search history.

(56) References Cited

U.S. PATENT DOCUMENTS

2007/0140714 A1* 6/2007 Kurita ..... G03G 15/5037 399/44
2009/0169227 A1* 7/2009 Kanai ..... G03G 15/0266 399/128
2013/0195475 A1* 8/2013 Kubo ..... G03G 15/0283 399/26
2013/0259502 A1* 10/2013 Motomura ..... G03G 15/0266 399/50
2016/0282745 A1* 9/2016 Komatsu ..... G03G 15/0266

FOREIGN PATENT DOCUMENTS

JP 2006071760 A * 3/2006
JP 2014006561 A 1/2014
JP 2014149338 A 8/2014
JP 2015148789 A 8/2015

OTHER PUBLICATIONS

Machine Translation of JP2006-071760. Mar. 16, 2006. (Year: 2006).*

* cited by examiner

*Primary Examiner* — Carla J Therrien
(74) *Attorney, Agent, or Firm* — Holtz, Holtz & Volek PC

(57) ABSTRACT

An image forming apparatus includes: a photoreceptor including a surface layer; a storage that stores a target value of a variation of a film thickness of the surface layer; and a hardware processor that acquires a variation of the film thickness in a first period within which the photoreceptor rotates a predetermined number of times, and sets a margin that is an amount of a portion for allowance with respect to a proper value of a parameter related to control of the photoreceptor, the margin being to be employed after the first period.

13 Claims, 11 Drawing Sheets

| DATA No. | NUMBER OF ROTATIONS AT 35°C OR HIGHER (rot) | VARIATION OF FILM THICKNESS AT 35°C OR HIGHER (μm) |
|---|---|---|
| 1 | 6000 | 0.20 |
| 2 | 1050 | 0.04 |
| 3 | 2600 | 0.15 |
| ACCUMULATED VALUE | 9650 | 0.39 |

IMAGE FORMING APPARATUS AND METHOD FOR CONTROLLING IMAGE FORMING APPARATUS

The entire disclosure of Japanese patent Application No. 2017-217066, filed on Nov. 10, 2017, is incorporated herein by reference in its entirety.

BACKGROUND

Technological Field

The present invention relates to an image forming apparatus and a method for controlling the image forming apparatus. More specifically, the present invention relates to an image forming apparatus including a photoreceptor including a surface layer and a method for controlling the image forming apparatus.

Description of the Related Art

An electrophotographic image forming apparatus includes a Multi Function Peripheral (MFP), a facsimile machine, a copying machine, a printer, and the like. The MFP may have a scanner function, a facsimile function, a copying function, a function as a printer, a data communication function, and a server function.

An image forming apparatus generally forms an image on a sheet by the following method. The image forming apparatus forms an electrostatic latent image on an image carrier and develops the electrostatic latent image using a developing device to form a toner image. Next, the image forming apparatus transfers the toner image to a sheet, and fixes the toner image on the sheet by the fixing device. Alternatively, some image forming apparatuses form a toner image on a photoreceptor, transfer the toner image to an intermediate transfer belt using a primary transfer roller, and secondarily transfer the toner image on the intermediate transfer belt to the sheet using a secondary transfer roller.

The electrostatic latent image on the photoreceptor is formed by charging the surface of the photoreceptor and patterning the electrostatic latent image with an exposing device. Electrophotographic charging methods include a corona discharge method and a contact discharge method. Among them, the contact discharge method is a charging method in which a charging roller, which is a roller-shaped charging member, is disposed in contact with or in close proximity to the surface of the photoreceptor, and a charging voltage is applied to the charging roller to perform proximity discharge, thereby charging the surface of the photoreceptor. The contact discharge method is advantageous in a point that it can reduce generation of oxides (ozone and the like) caused by high pressure current flowing through the air. As a charging method in an image forming apparatus used in an office, from the viewpoint of reducing ozone for the purpose of environmental conservation, a contact discharge method using a charging roller has become mainstream.

The contact charging method includes a direct current (DC) charging method in which only a DC voltage is used as a charging voltage to be applied to a charging roller and an alternating current (AC) charging method in which a voltage obtained by superimposing an AC component on a DC component is used as the charging voltage.

In the AC charging method, discharge and static elimination between the charging roller and the photoreceptor are forcibly repeated by the AC component. Thus, the AC charging method has a higher charging ability than the DC charging method, and has an advantage of high uniformity of the potential of the surface of the photoreceptor after charging (charging uniformity) because of the action of the alternating electric field. On the other hand, the AC charging method is disadvantageous in that the surface layer of the photoreceptor is easily abraded. The AC charging method is becoming mainstream. An important factor in the AC charging method is a peak-to-peak voltage (hereinafter, may be referred to as peak-to-peak voltage Vpp). The peak-to-peak voltage Vpp is a difference between the maximum value and the minimum value of the AC component of the charging voltage.

FIG. 13 is a graph illustrating a relationship between a peak-to-peak voltage Vpp and a surface potential of the photoreceptor.

With reference to FIG. 13, in the AC charging method, the surface potential is not determined linearly with respect to the voltage unlike the DC charging method. In the AC charging method, when the peak-to-peak voltage Vpp is equal to or higher than a voltage value V11, the surface potential of the photoreceptor is stabilized. Therefore, in the AC charging method, the surface potential of the photoreceptor can be easily controlled. However, even when the surface potential of the photoreceptor is stabilized, minute charging ununiformity is present on some points of the surface of the photoreceptor, and this charging ununiformity causes generation of image noise such as white spots and color spots due to discharging failure. Thus, it is necessary to set the peak-to-peak voltage Vpp to be equal to or higher than a proper value V12 (>V11) that is the voltage value at which minute charging ununiformity disappears. Further, even if it is attempted to apply the peak-to-peak voltage Vpp that is the proper value V12 to the charging roller, the peak-to-peak voltage Vpp actually applied to the charging roller may not be the proper value V12 due to variation of power supplies, resistor units, controls, or the like. Therefore, in actual control, a voltage value V13 (>V12) obtained by adding a certain amount of margin (about 50 V to 200 V) to the proper value V12 is set as the peak-to-peak voltage Vpp.

If the margin of the peak-to-peak voltage Vpp is too small, the peak-to-peak voltage Vpp falls below the proper value V12, and there is a possibility of occurrence of image noise due to minute discharge ununiformity. Therefore, conventionally the margin of the peak-to-peak voltage Vpp is set to a sufficiently large value.

As a conventional technique for appropriately determining the peak-to-peak voltage Vpp, a technique for determining the peak-to-peak voltage Vpp based on the film thickness of the surface layer of a photoreceptor is disclosed in, for example, JP 2015-148789 A, JP 2014-6561 A, and JP 2014-149338 A, JP 2015-148789 A discloses a technique in which the thickness of the surface of a photoreceptor drum is detected based on the 1-V characteristic exhibited by the charging current when a plurality of different voltages are applied, the ambient temperature and humidity of the apparatus and the photoreceptor drum are detected, the detected film thickness is corrected using a correction value determined corresponding to the detected temperature and humidity, and a charging voltage corresponding to the corrected film thickness is determined.

JP 2014-6561 A discloses a technique in which the film thickness of a photoreceptor is detected using a direct current voltage, and the current value of the AC test current is set lower as the film thickness is smaller.

JP 2014-149338 A discloses an image forming apparatus including an estimation unit that estimates a thickness of a film based on a given speed value indicating a decreasing speed of the film thickness, and a correcting unit that corrects the speed value to be provided to the estimation unit and used for next estimation based on a result of comparison of the thickness having been measured by the measurement unit and the thickness having been estimated by the estimation unit.

The above-described conventional techniques aim improvement of the accuracy of voltage control, but their main object is to suppress image noise due to charging failure. Regarding the abrasion of the surface layer of the photoreceptor, they aim only secondary improvement by controlling the peak-to-peak voltage Vpp appropriately. That is, in the above-described conventional techniques, the film thickness of the surf ace layer of the photoreceptor is acquired as one piece of error information, and using the film thickness, an appropriate peak-to-peak voltage Vpp is applied.

In the above-described conventional techniques, with consideration of the influence of the error factors such as variation of power supplies, resistor units, controls, or the like as described above, a sufficient margin (hereinafter, may be referred to as a margin of the peak-to-peak voltage Vpp) is added to the proper value V12 of the determined peak-to-peak voltage Vpp.

Meanwhile, according to recent research, it has been found that especially when a photoreceptor is at a high temperature (when double-sided printing or continuous printing is performed), even slightly large margin of the peak-to-peak voltage Vpp causes the surface layer of the photoreceptor to wear quickly, remarkably reducing the life of the photoreceptor.

FIG. 14 is a graph illustrating a relationship between the margin of the peak-to-peak voltage Vpp and the wear variation of the surface layer of the photoreceptor. A line LN1 in FIG. 14 is a line illustrating a relationship between the margin of the peak-to-peak voltage Vpp and the wear variation when the photoreceptor is at a high temperature. A line LN2 in FIG. 14 is a line illustrating a relationship between the margin of the peak-to-peak voltage Vpp and the wear variation when the photoreceptor is at a normal temperature lower than the high temperature.

With reference to FIG. 14, in general, the margin of peak-to-peak voltage Vpp is set to a value within a range RG of 50 V to 200 V. When the photoreceptor is at a normal temperature, the wear variation is within a range equal to or less than a threshold value TH1 indicating a normal wear variation as long as the margin of the peak-to-peak voltage Vpp is within the range RG, On the other hand, when the photoreceptor is at a high temperature, the wear variation is larger compared to that when the photoreceptor is at a normal temperature and exceeds a threshold TH2 indicating an upper limit of a normal range of the wear variation when the margin of the peak-to-peak voltage Vpp exceeds about 100 V.

The reason why the wear variation is large when the photoreceptor is at a high temperature is presumed that the amount of current flowing through the photoreceptor (discharge current amount) with respect to a certain peak-to-peak voltage Vpp increases, and the surface layer of the photoreceptor is more easily removed by discharge.

Due to the longer life of the photoreceptor in recent years, if the increase rate of the wear variation with respect to the margin of the peak-to-peak voltage Vpp is large even slightly, the influence on the life of the photoreceptor is large. In other words, if the lifetime of the photoreceptor is prolonged twice as long as the conventional one, the influence of the increase rate of the wear variation on the length of the life of the photoreceptor becomes twice even if the increase rate of the wear variation is the same as the increase rate of the conventional photoreceptor.

In a conventional technique, a certain amount of margin is secured for determined values of parameters related to control of a photoreceptor such as a contact pressure of a cleaning blade for cleaning the photoreceptor and a difference between rotation speeds of an intermediate transfer belt and a photoreceptor (peripheral speed difference) in addition to the peak-to-peak voltage Vpp. The margins of these parameters, as well as the margin of the peak-to-peak voltage Vpp, largely influence the life of the photoreceptor.

SUMMARY

The present invention has been made to solve the above problem, and an object of the present invention is to provide an image forming apparatus and a method for controlling an image forming apparatus capable of preventing a reduction of the life of a photoreceptor.

To achieve the abovementioned object, according to an aspect of the present invention, an image forming apparatus reflecting one aspect of the present invention comprises: a photoreceptor including a surface layer; a storage that stores a target value of a variation of a film thickness of the surface layer; and a hardware processor that acquires a variation of the film thickness in a first period within which the photoreceptor rotates a predetermined number of times, and sets a margin that is an amount of a portion for allowance with respect to a proper value of a parameter related to control of the photoreceptor, the margin being to be employed after the first period.

BRIEF DESCRIPTION OF THE DRAWINGS

The advantages and features provided by one or more embodiments of the invention will become more fully understood from the detailed description given hereinbelow and the appended drawings Which are given by way of illustration only; and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

In the following embodiments, a case where the image forming apparatus is a multifunction printer (MFP) will be described. Other than the MFP, the image forming apparatus may be a facsimile machine, a copying machine, a printer, or the like.

First Embodiment

First, a configuration of an image forming apparatus according to the present embodiment will be described.

Figure 1:
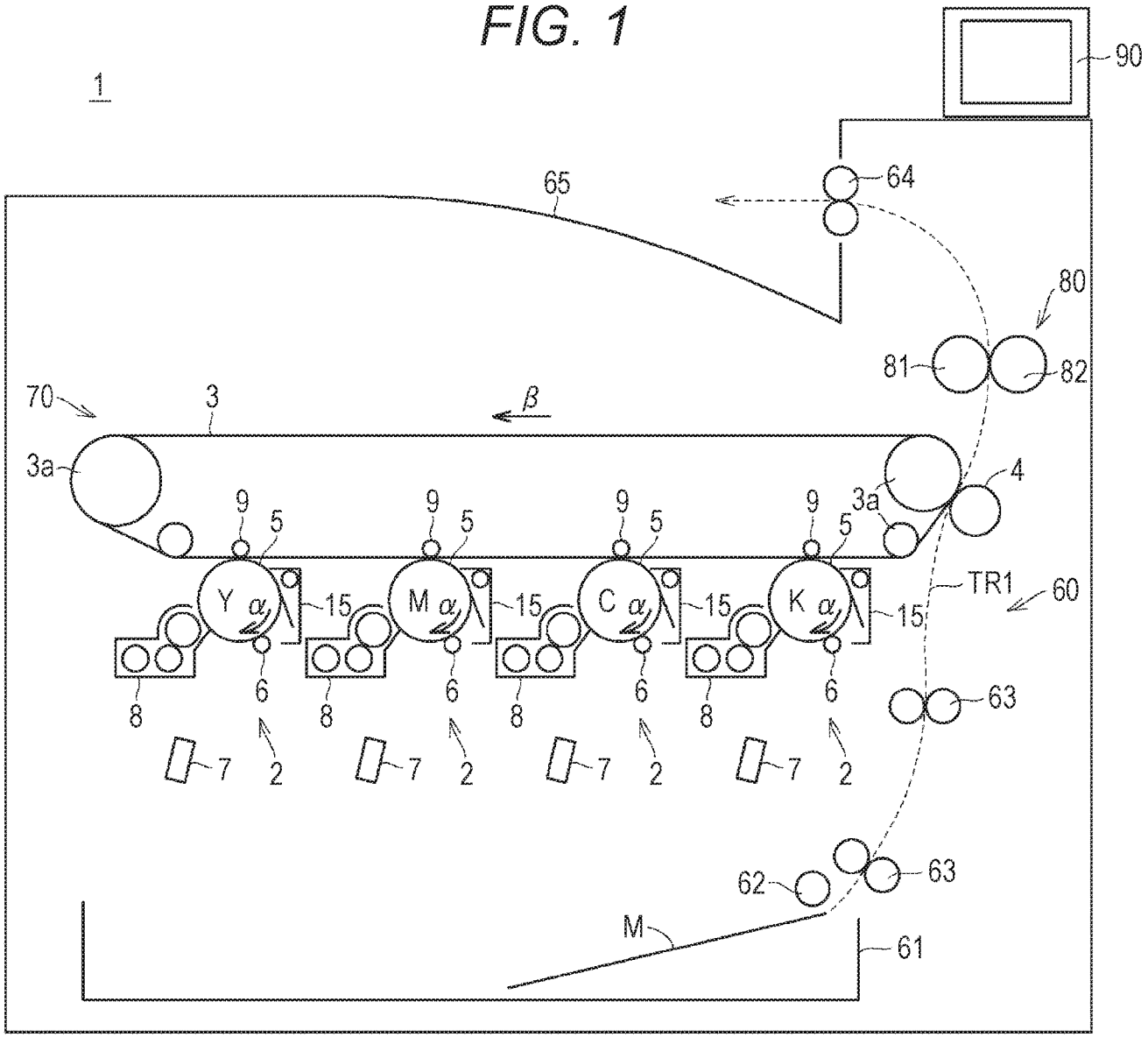
FIG. 1 is a cross-sectional view illustrating a configuration of an image forming apparatus according to a first embodiment of the present invention.

FIG. 1 is a cross-sectional view illustrating a configuration of an image forming apparatus 1 according to a first embodiment of the present invention.

With reference to FIG. 1, the image forming apparatus 1 according to the present embodiment prints an image such as a full color image or a monochrome image on a sheet M by a well-known electrophotographic method and a tandem method. The image forming apparatus 1 mainly includes a sheet conveying part 60, a toner image former 70, a fixing device 80, and an operation panel 90.

The sheet conveying part 60 includes a sheet feed tray 61, a sheet feed roller 62, a plurality of conveying rollers 63, a sheet discharge roller 64, and a sheet discharge tray 65. The sheet feed tray 61 accommodates sheets M on which an image is to be formed. A plurality of sheet feed trays 61 may be provided. The sheet feed roller 62 is provided between the sheet feed tray 61 and a conveying path TR1. Each of the plurality of conveying rollers 63 is provided along the conveying path TR1. The sheet discharge roller 64 is provided at the most downstream portion of the conveying path TR1. The sheet discharge tray 65 is provided at the uppermost portion of the image forming apparatus main body.

The toner image former 70 synthesizes images of four colors of yellow (Y), magenta (M), cyan (C), and black (K) by a so-called tandem method, and transfers the toner image to the sheet. The toner image former 70 includes an image firmer 2 of each color of Y, M, C, and K, an intermediate transfer belt 3, a primary transfer roller 9 for each color of Y, M, C, and K, and a secondary transfer roller 4.

The image former 2 of each color of Y, M, C, and K includes a photoreceptor 5, a charging roller 6, an exposing device 7, a developing device 8, a cleaning device 15, and the like. The photoreceptor 5 is rotationally driven in a direction indicated by an arrow a in FIG. 1. The photoreceptor 5 includes a surface layer 5*a* (FIG. 2) which is a photosensitive layer. The charging roller 6, the developing device 8, and the cleaning device 15 are arranged around the photoreceptor 5. The charging roller 6 is disposed in close proximity to the photoreceptor 5. The exposing device 7 is provided under the photoreceptor 5.

The intermediate transfer belt 3 is provided above the image formers 2 of colors of Y, M, C, and K. The intermediate transfer belt 3 is endless and is laid over rotating rollers 3*a*. The intermediate transfer belt 3 is rotationally driven in a direction indicated by an arrow (3 in FIG. 1. Each of the primary transfer rollers 9 faces corresponding one of the photoreceptors 5 with the intermediate transfer belt 3 interposed therebetween. The secondary transfer roller 4 is in contact with the intermediate transfer belt 3 in the conveying path TR1. The distance between the secondary transfer roller 4 and the intermediate transfer belt 3 can be adjusted by a pressure contact and separation mechanism (not illustrated).

A fixing device 80 includes a heating roller 81 and a pressure roller 82. The fixing device 80 fixes the toner image on a sheet by conveying the sheet along the conveying path TR1 while gripping the sheet carrying a toner image by the nip portion formed by the heating roller 81 and the pressure roller 82.

In the image forming apparatus 1, the photoreceptors 5 are rotated to charge the surfaces of the photoreceptors 5 by the charging rollers 6. In the image forming apparatus 1, the surface of the charged photoreceptor 5 is exposed by the exposing device 7 according to image formation information, and an electrostatic latent image according to the image formation information is formed on the surface of the photoreceptor 5.

Next, the image forming apparatus 1 supplies toner front the developing device 8 to the photoreceptor 5, on which the electrostatic latent image has been formed, to develop the toner image to form a toner image on the surface of the photoreceptor 5.

Next, the image forming apparatus 1 sequentially transfers the toner images formed on the photoreceptors 5 to the surface of the intermediate transfer belt 3 by using the primary transfer rollers 9 (primary transfer). When a full color image is formed, a toner image obtained by synthesizing toner images of colors of Y, M, C, and K is formed on the surface of the intermediate transfer belt 3.

In the image forming apparatus 1, toner remaining on the photoreceptors 5 without being transferred to the intermediate transfer belt 3 is removed by the cleaning devices 15.

In the image forming apparatus 1, the loner image formed on the surface of the intermediate transfer belt 3 is then conveyed to a position facing the secondary transfer roller 4 by the rotating rollers 3*a*.

On the other hand, in the image forming apparatus 1, a sheet M accommodated in the sheet feed tray 61 is fed by the sheet feed roller 62, and each of the plurality of conveying rollers 63 guides the sheet M between the intermediate transfer belt 3 and the secondary transfer roller 4 along the conveying path TR1. In the image forming apparatus 1, the toner image formed on the intermediate transfer belt 3 is then transferred to the sheet M by the secondary transfer roller 4.

In the image forming apparatus 1, the sheet M to which the toner image has been transferred is guided to the fixing device 80, and the fixing device 80 fixes the toner image on the sheet M. Thereafter, in the image forming apparatus 1, the sheet discharge roller 64 discharges the sheet M on which the toner image has been fixed to the sheet discharge tray 65.

The operation panel 90 displays various types of information and accepts various operations.

Figure 2:
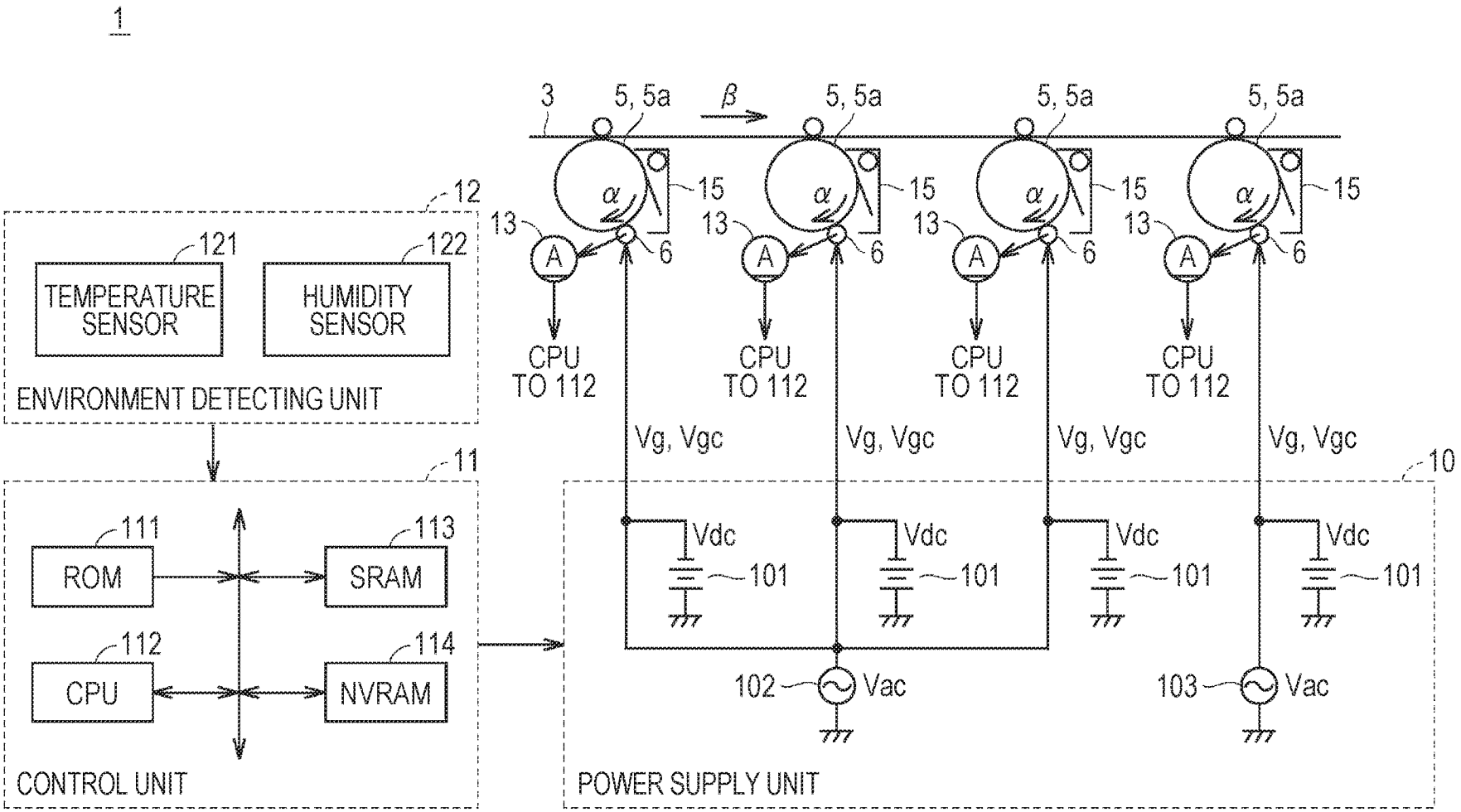
FIG. 2 is a cross-sectional view schematically illustrating a configuration of image formers of the image forming apparatus according to the first embodiment of the present invention and the periphery thereof.

FIG. 2 is a cross-sectional view schematically illustrating a configuration of the image formers 2 of the image forming apparatus 1 according to the first embodiment of the present invention and the periphery thereof.

With reference to FIG. 2, the image forming apparatus 1 further includes a power supply unit 10, a control unit 11, an environment detection unit 12, and a current detection unit 13.

The power supply unit 10 applies a charging voltage Vg to the charging roller 6 under the control of the control unit 11. The charging voltage Vg is obtained by superimposing an AC component (AC voltage) Vac on a DC component (DC voltage) Vdc. The power supply unit 10 includes a DC power supply circuit 101, an AC power supply circuit 102, and an AC power supply circuit 103 for each color of Y, M, C, and K. One end of each of the DC power supply circuit 101 and the AC power supply circuit 102 of each color of Y, M, and C is electrically connected to the charging roller 6 of each color of Y, M, and C. The other end of each of the DC power supply circuit 101 and the AC power supply circuit 102 of each color of Y, M, and C is grounded. One end of each of the DC power supply circuit 101 and the AC power supply circuit 103 of color of K is electrically connected to the charging roller 6 of color of K. The other end of each of the DC power supply circuit 101 and AC power supply circuit 103 of color of K is grounded.

The DC power supply circuit 101 outputs the DC component Vdc of the charging voltage Vg under the control of the control unit 11. The DC power supply circuit 101 is separately provided for each color, so that a DC component Vdc of the charging voltage of each color can be adjusted.

In addition, each of the AC power supply circuits 102 and 103 is constituted of, for example, an AC transformer, and outputs an AC component Vac of the charging voltage Vg under the control of the control unit 11. In the present embodiment, for convenience of description, it is assumed that the DC component Vdc and the AC component Vac are the same for all colors of M, C, and K.

The control unit 11 includes a Read Only Memory (ROM) 111, a Central Processing Unit (CPU) 112, a Static Random Access Memory (SRAM) 113, and a Non-Volatile Random Access Memory (NVRAM) 114. The ROM 111 stores a control program and the like. The CPU 112 controls the entire image forming apparatus 1 based on the control program. The SRAM 113 is a main memory of the CPU 112. The SRAM 113 is used to temporarily store data required for the CPU 102 to execute the control program, and the like. The NVRAM 114 stores various types of data, tables, and the like.

The environment detection unit 12 includes a temperature sensor 121 and a humidity sensor 122. The temperature sensor 121 detects the temperature inside the image forming apparatus 1 and outputs it to the CPU 112. The humidity sensor 122 detects the humidity inside the image forming apparatus 1 and outputs it to the CPU 112. Here, the temperature measured by the temperature sensor 121 is used as the temperature of the photoreceptors 5.

When the charging voltage Vg or the charging voltage for detection Vgc is applied to the charging roller 6 of each color of M, C, and K, the current detection unit 13 detects an AC current value Iac flowing through the corresponding photoreceptor 5. The detected AC current value Iac is fed back to the CPU 112.

Meanwhile, the surface layer 5*a* of the photoreceptor 5 is abraded by the use of the photoreceptor 5 to decrease the film thickness. Representative methods for detecting the film thickness of the surface layer 5*a* include the following first to fourth methods. The first method is a method of detecting the film thickness based on the variation of the surface potential of the photoreceptor 5. The second method is a method of detecting the film thickness from the variation of the film thickness of the surface layer 5*a*, The third method is a method of detecting the film thickness using the number of rotations of the photoreceptor 5. The fourth method is a method of detecting the film thickness based on the AC current value Iac with respect to the voltage applied to the photoreceptor 5.

Among these methods, the first method is often employed in the case of the DC charging method in which the film thickness of the surface layer 5*a* and the surface potential of the photoreceptor 5 have a linear correlation, and is not usually employed in the case of the AC charging method such as this embodiment. Further, the first method requires a configuration for measuring the surface potential of the photoreceptor 5, and the second method requires a configuration for measuring the variation of the film thickness of the photoreceptor 5. In the third method, the amount of wear of the film thickness of the surface layer 5*a* is affected by fluctuation of the environmental conditions. Thus, the film thickness of the surface layer 5*a* cannot be detected with high accuracy. On the other hand, the fourth method has various advantages as compared with the first to third methods. According to the fourth method, the AC current value Iac and the film thickness of the surface layer 5*a* have a high correlation with the voltage applied to the photoreceptor 5. Thus, the film thickness can be detected with relatively high accuracy. In addition, the film thickness can be detected only by adding a configuration for detecting the AC current value Iac. That is, the film thickness can be detected by a simple configuration. In these days, the fourth method is the mainstream method of detecting the film thickness.

In the following description, it is assumed that the film thickness of the surface layer 5*a* is detected using the fourth method. The method of detecting the film thickness of the surface layer 5*a* is not limited to the fourth method and any method can be employed.

As a premise of the present embodiment, the image forming apparatus 1 performs charging control for setting a peak-to-peak voltage Vpp depending on the environmental fluctuation during a day or from day to day and the deterioration of the photoreceptor 5. In the present embodiment, ΔIac control is performed as charging control capable of ensuring a certain margin against an error of environmental fluctuation and degradation of the photoreceptor 5 as much as possible.

Figure 3:
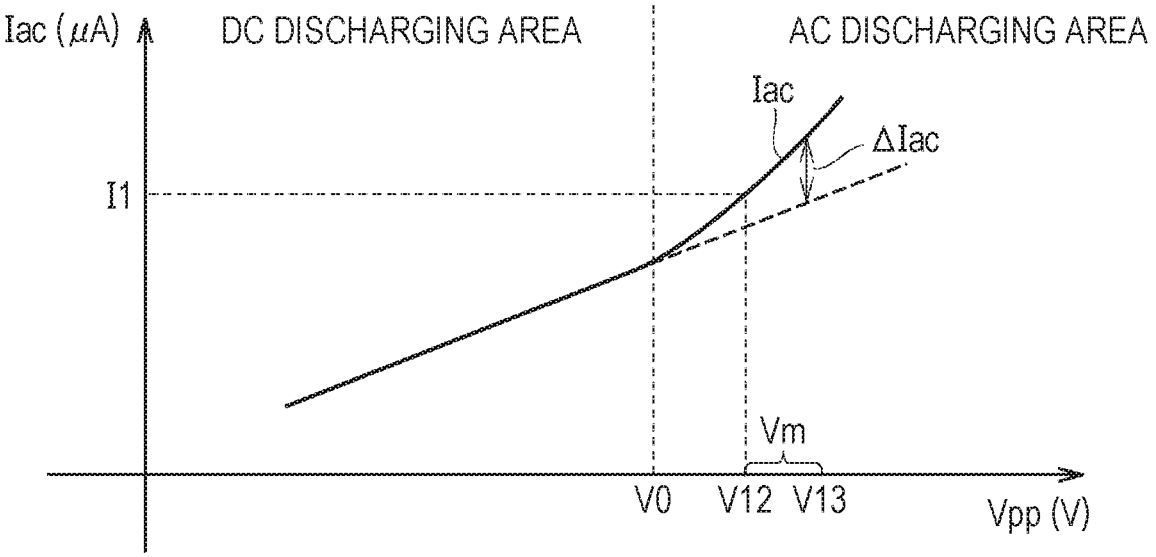
FIG. 3 is a graph illustrating a relationship between a peak-to-peak voltage Vpp and an AC current value Iac.

FIG. 3 is a graph illustrating the relationship between the peak-to-peak voltage Vpp and the AC current value Iac.

With reference to FIG. 3, in the DC discharging area where the peak-to-peak voltage Vpp is less than discharge starting voltage V0, only DC discharge occurs between the charging roller 6 and the photoreceptor 5, and AC discharge does not occur therebetween. In the DC discharging area, the AC current value Iac flowing between the charging roller 6 and the photoreceptor 5 linearly increases with increase of the peak-to-peak voltage Vpp. In the AC discharging area where the peak-to-peak voltage Vpp is equal to or higher than the discharge starting voltage V0, both AC discharge and DC discharge occur between the charging roller 6 and the photoreceptor 5. In the AC discharging area, the AC current value Iac gradually deviates in the increasing direction. This deviation in the increasing direction is due to increase of the current involved in the AC discharge. The amount of increase of the AC current value Iac in the increasing direction is referred to as a discharge current ΔIac.

In the ΔIac control, a target discharge current ΔIac is calculated based on the V (voltage)-I (current) characteristic of the photoreceptor 5, and the peak-to-peak voltage Vpp is controlled such that the discharge current ΔIac becomes the target discharge current ΔIac.

The ΔIac control is based on an idea that, even if there is variation of the resistance value of the charging rollers 6 or variation of the film thickness of the surface layer 5*a* among individuals, the photoreceptors 5 charged by void discharge have an identical charging property as long as the amount of the discharge current ΔIac is identical. However, strictly speaking, it has been found that the discharge current ΔIac required for obtaining a constant charging property of the photoreceptor 5 differs depending on the environment and the film thickness of the surface layer 5*a*. Therefore, in the actual ΔIac control, the target discharge current ΔIac is changed based on the environment and the film thickness by using a table showing the relationship of the target discharge current ΔIac with the environment and the film thickness.

However, even if the target discharge current ΔIac is changed based on the environment and the film thickness referring to the table, in switching parts of the range of the environment and the film thickness in the table, a deviation tends to occur between the optimum peak-to-peak voltage Vpp and the actually set peak-to-peak voltage Vpp. In addition, the film thickness at the initial stage of use of the photoreceptor 5, the output of the power supply unit 10, the output of the current detection unit 13, and the like may vary among individuals. When the set peak-to-peak voltage Vpp becomes a value lower than the optimum value in consideration of the environment and the film thickness due to these variations, the image quality may be deteriorated.

Therefore, in order to allow avoidance of deterioration of the image quality even when such variations exist, in general, the peak-to-peak voltage Vpp set in the ΔIac control is V13 (=V12+Vm) obtained by adding a predetermined margin Vm (Vm>0) to the proper value V12 of the peak-to-peak voltage Vpp necessary to obtain a target value I1 of the discharge current ΔIac. The margin is an amount of a portion for allowance with respect to a proper value of the parameter. As an example, the output variation of the power supply unit 10 is normally about ±30 V Therefore, as a margin Yin of the peak-to-peak voltage Vpp, about 50 V to 100 V is secured in consideration of other variations. On the other hand, if the margin Vm of the peak-to-peak voltage Vpp is large, the wear of the surface layer 5*a* is accelerated and the life of the photoreceptor 5 is remarkably reduced.

Thus, the image forming apparatus 1 acquires the variation of the film thickness of the surface layer 5*a* during a first period during Which the photoreceptor 5 rotates a predetermined number of times. The image forming apparatus 1 then sets a margin of the peak-to-peak voltage Vpp to be employed and set after the first period based on a deviation of the acquired variation from the target value, Typically, the image forming apparatus 1 gradually reduces the margin of the peak-to-peak voltage Vpp based on the film thickness information fed back as the accumulated number of rotations of the photoreceptor 5 increases.

Figure 4:
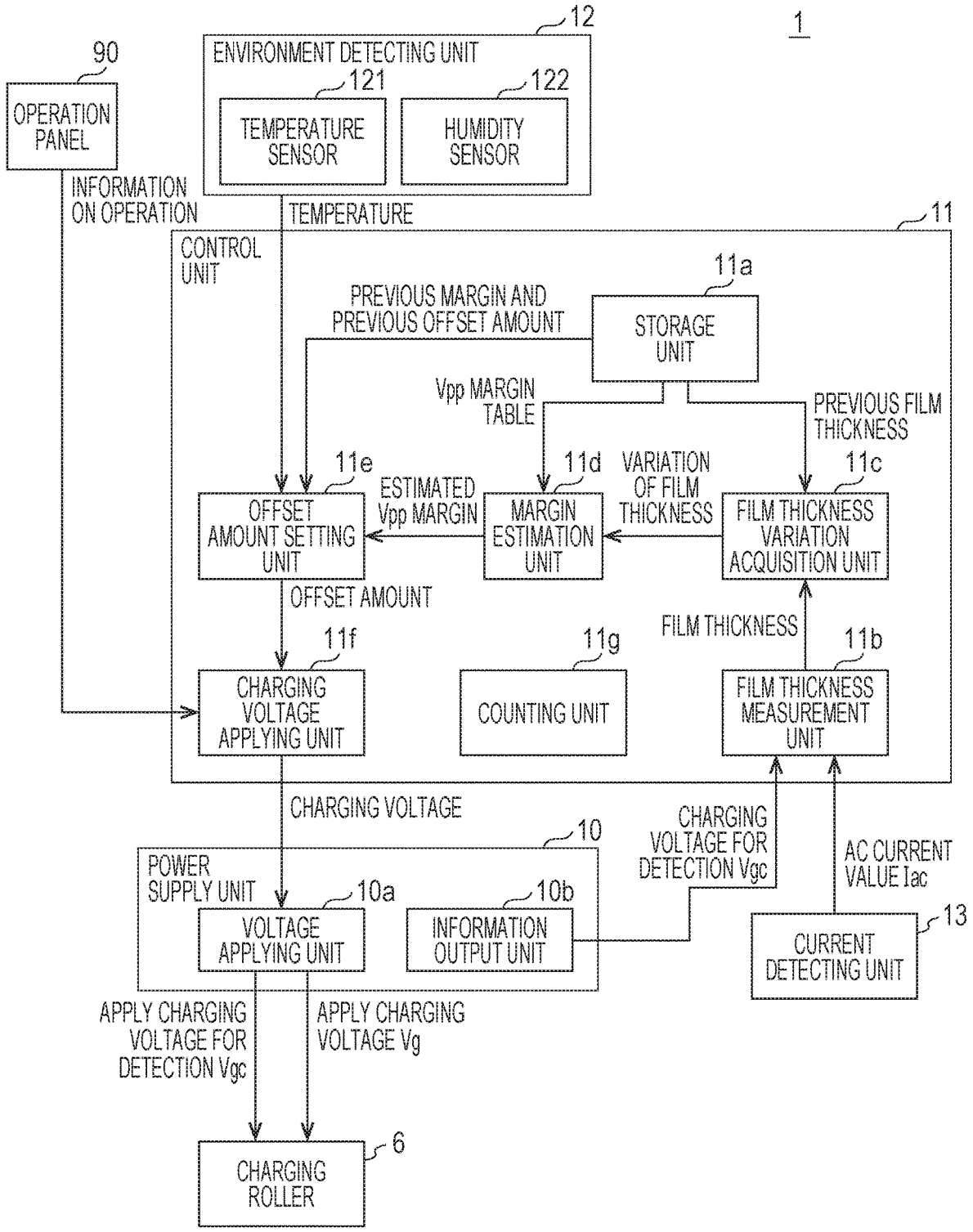
FIG. 4 is a block diagram illustrating a functional configuration related to the setting of a margin of the peak-to-peak voltage Vpp in the image forming apparatus according to the first embodiment of the present invention.

FIG. 4 is a block diagram illustrating a functional configuration related to the setting of the margin of the peak-to-peak voltage Vpp in the image forming apparatus 1 according to the first embodiment of the present invention.

With reference to FIG. 4, the power supply unit 10 includes a voltage applying unit 10*a* and an information output unit 10*b*. The voltage applying unit 10*a* applies the charging voltage Vg or the charging voltage for detection Vgc to the charging roller 6. When the voltage applying unit 10*a* applies the charging voltage for detection Vgc to the charging roller 6, the information output unit 10*b* outputs information on the charging voltage for detection Vgc to a film thickness measurement unit 11*b*.

The image forming apparatus 1 further includes the control unit 11, The control unit 11 controls the entire image forming apparatus 1, The control unit 11 includes a storage unit 11*a* (an example of a storage), the film thickness measurement unit 11*b*, a film thickness variation acquisition unit 11*e* (an example of an acquisitor), a margin estimation unit 11*d* (an example of an estimator), an offset amount setting unit 11*e* (an example of a setter), a charging voltage applying unit 11*f*, and a counting unit 11*g*.

Figure 7:
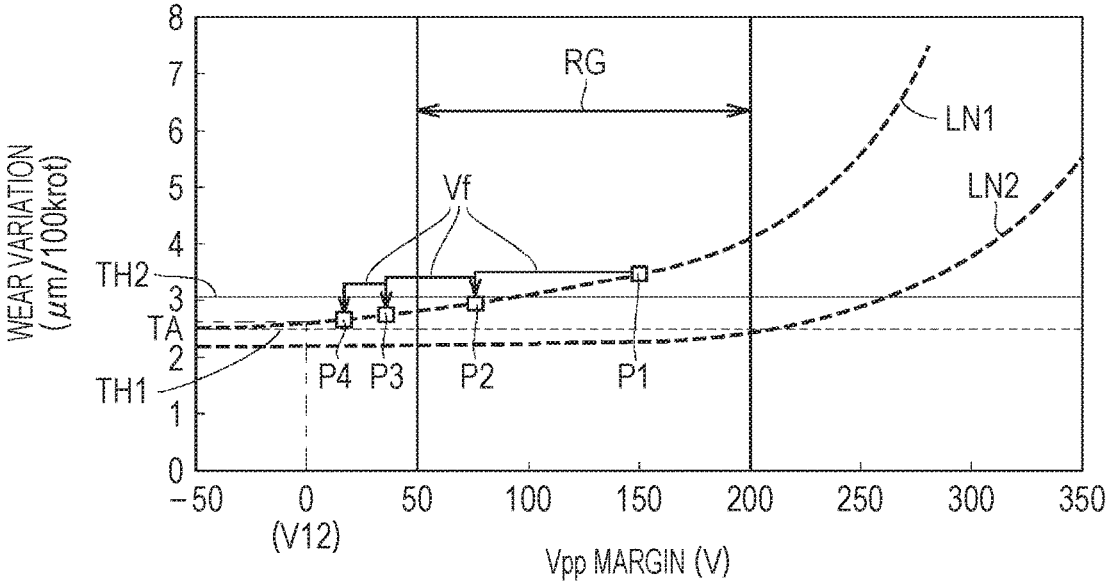
FIG. 7 is a diagram illustrating a method of estimating an estimated Vpp margin using Vpp margin tables in step S119 of FIG. 6.

The storage unit 11*a* stores a Vpp margin table shown in FIG. 7, a target value TA of the peak-to-peak voltage Vpp, a film thickness measured in the past by the film thickness measurement unit 11*b*, a variation of the film thickness calculated in the past by the film thickness variation acquisition, unit 11*c*, an estimated Vpp margin estimated by the margin estimation unit 11*d*, and an offset amount set in the past by the offset amount setting unit 11*e*.

The film thickness measurement unit 11*b* acquires information on the charging voltage for detection Vgc of the photoreceptor 5 from the information output unit 10*b* of the power supply unit 10 and acquires the AC current value Iac from the current detection unit 13. Based on the acquired information, the film thickness measurement unit 11*b* measures the film thickness of the surface layer 5*a* by using the above-described fourth method. The film thickness measurement unit 11*b* stores the calculated film thickness in the storage unit 11*a*.

The film thickness variation acquisition unit 11*c* acquires the film thickness of the surface layer 5*a* measured by the film thickness measurement unit 11*b* from the film thickness measurement unit 11*b* and acquires the film thickness of the surface layer 5*a* measured previously by the film thickness measurement unit 11*b* from the storage unit 11*a*. Based on the acquired information, the film thickness measurement unit 11*b* calculates (acquires) the variation of the film thickness of the surface layer 5*a* within a predetermined period (an example of the first period and the second period). The film thickness variation acquisition unit 11*c* stores the calculated variation of the film thickness in the storage unit 11*a*.

The margin estimation unit 11*d* acquires the variation of the film thickness calculated by the film thickness variation acquisition unit 11*c* from the film thickness variation acquisition unit 11*c* and acquires the Vpp margin table and the target value TA from the storage unit 11*a*. The target value TA is an estimated variation of the film thickness when the photoreceptor 5 rotates a predetermined number of times while the peak-to-peak voltage Vpp is set to the proper value V12. The margin estimation unit 11*d* estimates the estimated Vpp margin based on deviation of the acquired variation of the film thickness from the target value TA. The margin of the peak-to-peak voltage Vpp is an amount of a portion for allowance with respect to the proper value V12 of the peak-to-peak voltage Vpp. The estimated Vpp margin is a margin estimated to have been employed within the above-described predetermined period. The margin estimation unit 11*d* stores the estimated Vpp margin in the storage unit 11*a*.

The offset amount setting unit 11*e* acquires the estimated Vpp margin estimated by the margin estimation unit 11*d* from the margin estimation unit 11*d*, and acquires the estimated Vpp margin estimated previously and the estimated offset amount estimated previously from the storage unit 11*a*. Based on the acquired information, the offset amount setting unit 11*e* sets a margin to be employed after the predetermined period. Specifically, the offset amount setting unit 11*e* sets an offset amount to be added to the margin of the peak-to-peak voltage Vpp, and notifies the charging voltage applying unit 11*f* of the set offset amount. The offset amount setting unit 11*e* stores the set offset amount in the storage unit 11*a*.

The charging voltage applying unit 11*f* controls the voltage applying unit 10*a* to apply the charging voltage Vg to the charging roller 6. The charging voltage applying unit 11*f* sets the peak-to-peak voltage Vpp of the charging voltage Vg to be applied to the charging roller 6 to a value obtained by subtracting the offset amount from the peak-to-peak voltage Vpp having been set in the ΔIac control.

The counting unit 11*g* counts the number of rotations of the photoreceptor 5.

Figure 5:
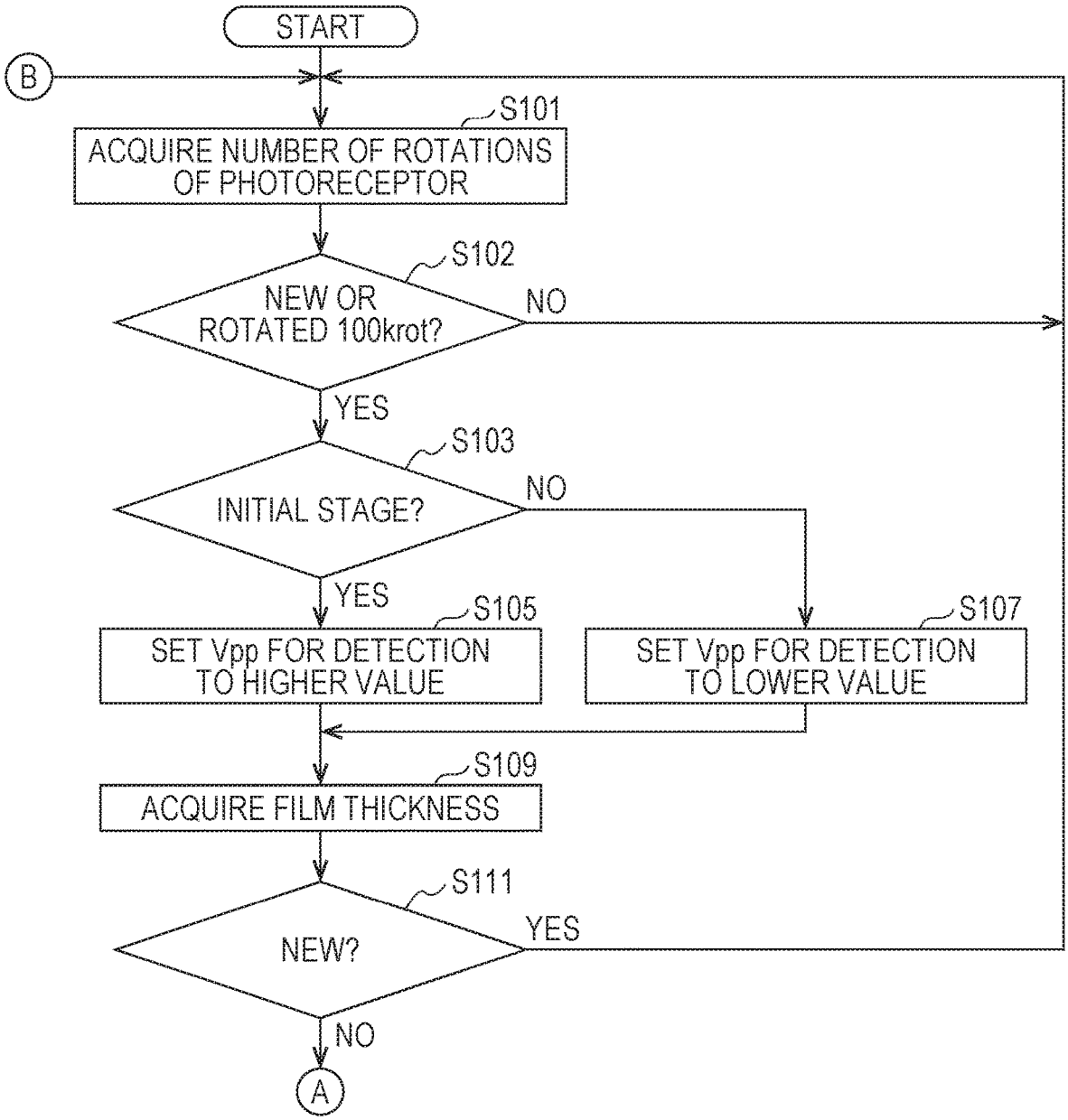
FIG. 5 illustrates a first portion of a flowchart of control executed by a control unit in the first embodiment of the present invention to control the peak-to-peak voltage Vpp of a charging voltage Vg to be applied to a charging roller.
Figure 6:
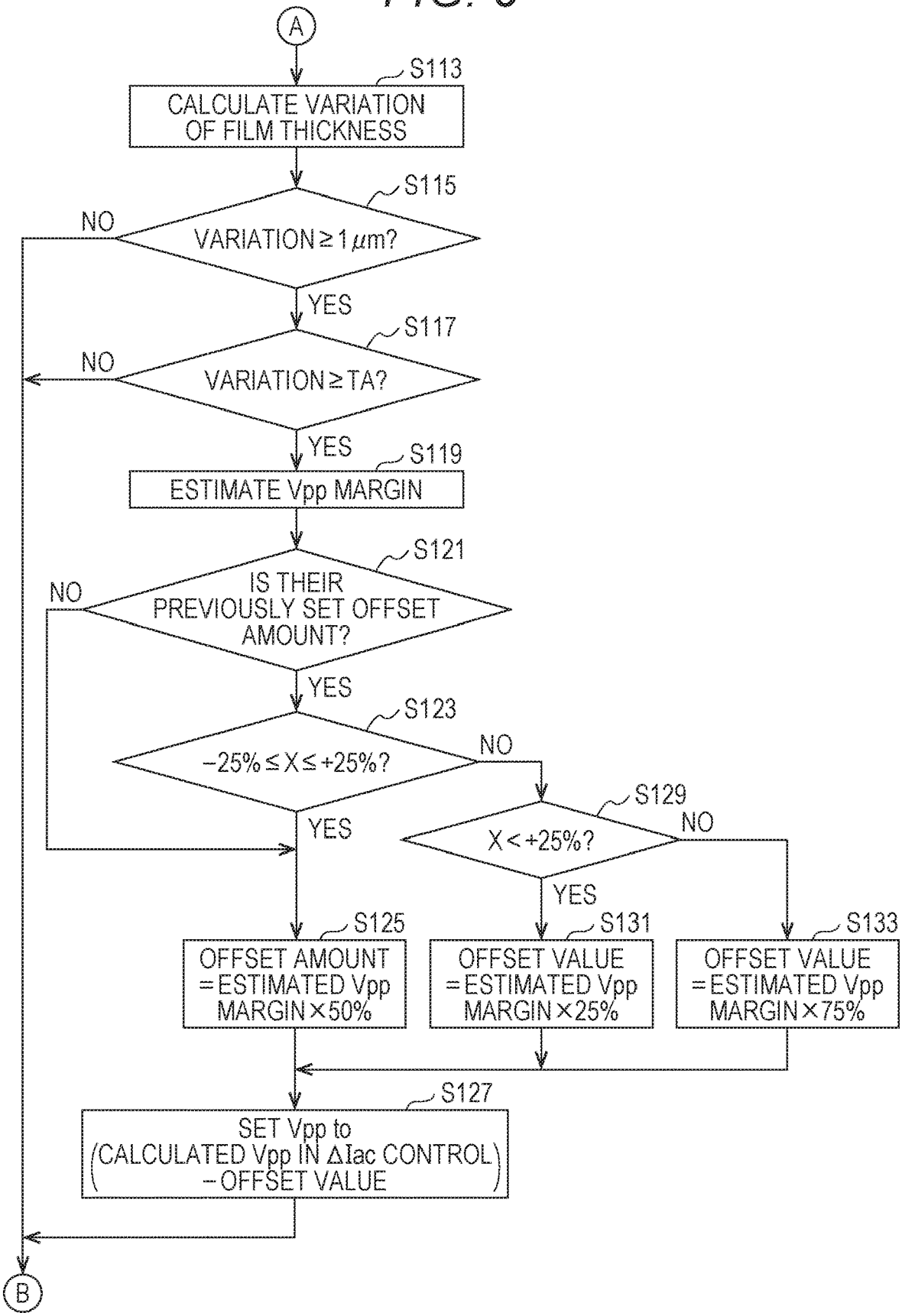
FIG. 6 illustrates a second portion of the flowchart of control executed by the control unit in the first embodiment of the present invention to control the peak-to-peak voltage Vpp of the charging voltage Vg to be applied to the charging roller.

FIGS. 5 and 6 illustrate a flowchart of the control executed by the control unit 11 in the first embodiment of the present invention to control the peak-to-peak voltage Vpp of the charging voltage Vg to be applied to the charging roller 6. The flowchart illustrated in FIGS. 5 and 6 is realized by the CPU 112 operating according to a control program stored in the ROM 111.

With reference to FIG. 5, the control unit 11 acquires the accumulated number of rotations of photoreceptor 5 at a predetermined timing (S101), and based on the acquired accumulated number of rotations, determines Whether the photoreceptor 5 is new or the accumulated number of rotations has increased by a predetermined number of rotations (S102).

In the present embodiment, it is assumed that the predetermined number of rotations is 100 krot. The predetermined number of rotations is preferably not less than 100 krot. This is because a certain variation of the film thickness (amount of wear) is necessary to detect the film thickness with high sensitivity.

If the control unit 11 determines in step S102 that the photoreceptor 5 is not new and the accumulated number of rotations has not increased by the predetermined number of rotations (NO in S102), the control unit 11 proceeds to the processing of step S101.

If the control unit 11 determines in step S102 that the photoreceptor 5 is new or the accumulated number of rotations has increased by the predetermined number of rotations (YES in S102), the control unit 11 determines whether the photoreceptor 5 is at the initial stage of use based on the acquired accumulated number of rotations (whether the accumulated number of rotations of the photoreceptor 5 is less than a predetermined reference number of rotations) (S103).

If the control unit 11 determines in step S103 that the photoreceptor 5 is at the initial stage of use (the accumulated number of rotations of the photoreceptor 5 is less than a predetermined reference number of rotations) (YES in S103), the control unit 11 sets the peak-to-peak voltage Vpp of the charging voltage for detection Vgc to a higher value (S105), and proceeds to the processing of step S109.

If the control unit 11 determines in step S103 that the photoreceptor 5 is not at the initial stage of use (the accumulated number of rotations of the photoreceptor 5 is more than the predetermined reference number of rotations) (NO in S103), the control unit 11 sets the peak-to-peak voltage Vpp of the charging voltage for detection Vgc to a lower value (S107), and proceeds to the processing of step S109.

In steps S105 and S107, the peak-to-peak voltage Vpp of the charging voltage for detection Vgc when the photoreceptor 5 is in the initial stage of use is set to a higher value than the peak-to-peak voltage Vpp of the charging voltage for detection Vgc when the photoreceptor 5 is not in the initial stage of use for the following reason. Since the current hardly flows between the charging roller 6 and the photoreceptor 5 at the initial stage of use of the photoreceptor 5, the detection sensitivity of the film thickness is low. Therefore, by setting the peak-to-peak voltage Vpp of the charging voltage for detection Vgc when the photoreceptor 5 is in the initial stage of use to a high value, the detection sensitivity of the film thickness can be improved. On the other hand, as the photoreceptor 5 is used more, the film thickness becomes smaller. Therefore, by setting the peak-to-peak voltage Vpp of the charging voltage for detection Vgc when the photoreceptor 5 is not in the initial stage of use to a lower value, damage to the photoreceptor 5 can be suppressed.

In step S109, the control unit 11 acquires (detects) the film thickness of the surface layer 5*a* of the photoreceptor 5 by applying the charging voltage for detection Vgc to the charging roller 6 and stores the film thickness in the storage unit 11*a* (S109). Next, the control unit 11 determines whether the photoreceptor 5 is new based on the acquired accumulated number of rotations (S111).

If the control unit determines in step S111 that the photoreceptor 5 is new (YES in S111), the film thickness stored in step S109 is the initial film thickness of the surface layer 5*a* of the photoreceptor 5. In this case, the control unit 11 does not set the offset amount. The control unit 11 performs printing by applying the charging voltage Vg having the voltage value V13 set in the ΔIac control as the actual peak-to-peak voltage Vpp to the charging roller 6. The control unit 11 proceeds to the processing of step S101.

If the control unit 11 determines in step S111 that the photoreceptor 5 is not new (NO in step S111), the control unit 11 proceeds to the processing of step S113 of FIG. 6.

With reference to FIG. 6, in step S113, the control unit 11 calculates the variation of the film thickness within a period within which the photoreceptor 5 rotates a predetermined times based on the previous film thickness stored in the storage unit 11*a* (the film thickness having been acquired before the latest acquisition of the film thickness in step S109) and the film thickness having been acquired in the latest acquisition in step S109 (S113). Subsequently, the control unit 11 determines whether the calculated variation of the film thickness is 1 μm or more (S115).

If the control unit 11 determines in step S115 that the calculated variation of the film thickness is not equal to or more than 1 μm (NO in S115), the control unit 11 does not set a new offset amount and sets the offset amount to a value equal to the offset amount set previously. The control unit 11 proceeds to the processing of step S101 of FIG. 5. This is because when the calculated variation of the film thickness is less than 1 μm, it can be estimated that the detection sensitivity of the film thickness is not sufficient. If the calculated variation of the film thickness is less than 1 μm, the amount of wear of the surface layer 5*a* is less than expected. In such a case, even if the offset amount is not set, the life of the photoreceptor 5 is not adversely affected.

It is to be noted that when the variation of the film thickness calculated in step S115 falls within a predetermined target range or when the difference between the calculated variation of the film thickness and the target value TA is a certain value or less, the control unit 11 may determine that the effect of improving the amount of wear of the film thickness due to the increase of the offset amount is reduced and suspend the setting of the offset amount. In this case, the charging control is performed while maintaining the already set offset amount.

If the control unit 11 determines in step S115 that the calculated variation of the film thickness is equal to or more than 1 μm (YES in S115), the control unit 11 determines whether the calculated variation of the film thickness is equal to or more than the target value TA of the variation of the film thickness (the variation of the film thickness per a predetermined number of rotations expected when the margin Vm is set to 0) (S117).

If the control unit 11 determines in step S117 that the calculated variation of the film thickness is not equal to or more than the target value TA of the variation of the film thickness (NO in S117), the control unit 11 does not set a new offset amount and sets the offset amount to a value equal to the offset amount set previously. The control unit 11 proceeds to the processing of step S101 of FIG. 5. If the calculated variation of the film thickness is less than the target value TA of the variation of the film thickness, the amount of wear of the surface layer 5*a* is less than expected. In such a case, even if the offset amount is not set, the life of the photoreceptor 5 is not adversely affected.

Note that, if the control unit 11 determines in step S117 that the calculated variation of the film thickness is not equal to or more than the target value TA of the variation of the film thickness (NO in S117), the control unit 11 may set the offset amount in a direction of increasing the margin of the peak-to-peak voltage Vpp (that is, the offset amount may be set to a minus value). Such setting makes it possible to prevent occurrence of filming and the like caused by the peak-to-peak voltage Vpp being lower than the proper value V12. However, since the conditions causing filming and the like are limited, it is preferable to avoid control that purposely increases the amount of wear of the film thickness from the viewpoint of prolonging the life of the photoreceptor 5.

If the control unit 11 determines in step S117 that the calculated variation of the film thickness is equal to or more than the target value TA of the variation of the film thickness (YES in S117), the amount of wear of the film thickness per the predetermined number of rotations is large and there is room for setting the offset amount to the peak-to-peak voltage Vpp. In this case, the control unit 11 sets the newly set margin of the peak-to-peak voltage Vpp to be smaller than the current estimated Vpp margin (estimated value of the peak-to-peak voltage Vpp currently set). Using the Vpp margin table shown in FIG. 7, the control unit 11 estimates the estimated Vpp margin from the calculated variation of the film thickness, stores the estimated value in the storage unit 11*a* (S119), and proceeds to the processing of step S121.

Note that the storage unit 11*a* preferably stores a plurality of different Vpp margin tables, and an appropriate Vpp margin table depending on the temperature and the frequency of the charging voltage Vg is used. Since the estimated Vpp margin is merely a guide for determining the offset amount for reducing the margin of the peak-to-peak voltage Vpp, the Vpp margin table may be any information as long as it can allow determination of an approximate value of the estimated Vpp margin.

In step S121, the control unit 11 refers to the storage unit 11*a* and determines whether there is a previously set offset amount (S121).

If the control unit 11 determines in S121 that there is not a previously set offset amount (NO in S121), an initial offset amount should be set. In this case, the control unit 11 sets an amount corresponding to 50% of the estimated Vpp margin estimated this time as the initial offset amount (S125) and proceeds to the processing of step S127.

If the control unit 11 determines in S121 that there is a previously set offset amount set (YES in S121), the control unit 11 is in a state where the second or later offset amount should be set. In this case, the control unit 11 calculates a value X (%) expressed by the following expression (1). The value X indicates the ratio of the actual variation of the film thickness to the estimated variation of the film thickness while the photoreceptor 5 rotates the predetermined number of times in a state where the previously set offset amount is employed. The control unit 11 determines whether the value X satisfies the expression, $-25\% \leq X \leq 25\%$ (S123).

$$\text{The value } X(\%) = \{\text{estimated } Vpp \text{ margin estimated this time}/(\text{estimated } Vpp \text{ margin previously estimated} - \text{previously set offset amount})\} \times 100 \quad (1)$$

If the control unit 11 determines in step S123 that the value X satisfies $-25\% \leq X \leq 25\%$ (YES in S123), the estimated Vpp margin estimated this time is a value that is almost the same as a value obtained by subtracting the offset amount that was set previously from the estimated Vpp margin that was previously set, which is a state where the margin of the peak-to-peak voltage Vpp gradually decreases as desired. In this case, the control unit 11 sets an amount corresponding to 50% of the estimated Vpp margin estimated this time as the offset amount this time (S125) and proceeds to the processing of step S127.

If the control unit 11 determines in step S123 that the value X does not satisfy the expression, $-25\% \leq X \leq +25\%$ (NO in S123), the control unit 11 determines whether the value X satisfies the expression, $X < +25\%$ (S129).

If the control unit 11 determines in step S129 that the value X satisfies the expression, $X < +25\%$ (YES in step S129), it means that the effect of improving the amount of wear of the film thickness due to the offset amount that was set previously is small, and there is a little room for increasing the offset amount (that is, the margin is close to zero). In this case, the control unit 11 sets an amount corresponding to 25% of the estimated Vpp margin estimated this time as an offset amount at this time (S131) and proceeds to the processing of step S127.

If the control unit 11 determines in step S129 that the value X does not satisfy the expression, $X < +25\%$ (NO in step S129), it means that the effect of improving the amount of wear of the film thickness due to the offset amount that was set previously is large, and there is a large room for further increasing the offset amount (that is, the margin is very large). In this case, the control unit 11 sets an amount corresponding to 75% of the estimated Vpp margin estimated this time as an offset amount at this time (S133) and proceeds to the processing of step S127.

As described in steps S125, S131, and S133, it is preferable that the offset amount set this time be a value obtained by subtracting, from the estimated Vpp margin, an offset amount that is a necessary proportion of the estimated Vpp margin that was estimated previously. This is because when the offset amount to be set is a constant amount regardless of the estimated Vpp margin, the margin of the peak-to-peak voltage Vpp may become 0 due to the variation of the control itself, the peak-to-peak voltage Vpp then falls below the proper value V12. This may cause charging failure. The necessary proportion may be any proportion, and the proportions of 25%, 50%, and 75% described above are examples.

In addition, from the comparison of the proportions of the offset amounts of 25%, 50%, and 75% in steps S125, S131, and S133, it can be seen that the proportion of the offset amount set this time is larger when the variation of the film thickness acquired this time is larger comparing to the estimated variation of the film thickness while the photoreceptor rotates the predetermined number of times in a state where the offset amount that was set previously is employed (in other words, when the value X is larger).

In step S127, the control unit 11 sets the peak-to-peak voltage Vpp of the charging voltage Vg to be actually applied to the charging roller 6 within a period of next 100 krot to a value obtained by subtracting the offset amount from the peak-to-peak voltage Vpp set in the ΔIac control (voltage value V13 in FIG. 3) (S127). As a result, the margin of the peak-to-peak voltage Vpp is reduced by the set offset amount. Thereafter, the control unit 11 proceeds to the processing of step S101 in FIG. 5.

Basically, the control is performed by repeating the loop of this flow chart until the life of the photoreceptor 5 ends.

FIG. 7 is a diagram illustrating a method of estimating the estimated Vpp margin using Vpp margin tables in step S119 of FIG. 6. FIG. 7 illustrates a Vpp margin table (line LN1 in FIG. 7) when the photoreceptor 5 is at a high temperature and a Vpp margin table (line LN2 in FIG. 7) when the photoreceptor 5 is at a normal temperature. Here, for convenience of description, a case of using the Vpp margin table when the photoreceptor 5 is at high temperature will be described.

Figure 14:
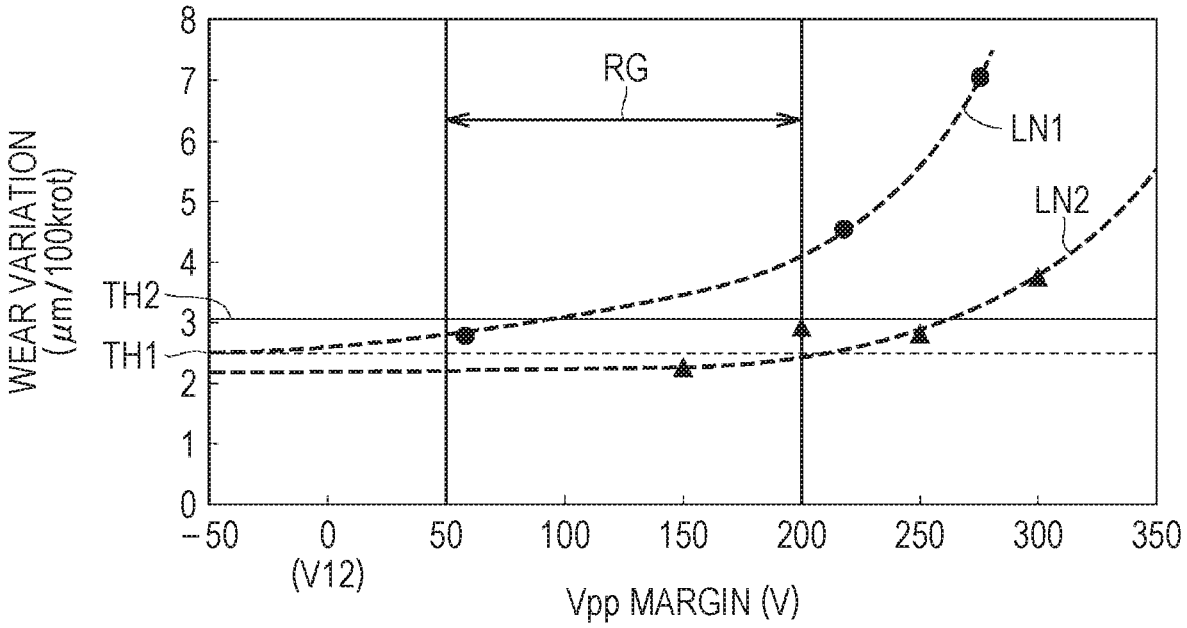
FIG. 14 is a graph illustrating a relationship between a margin of the peak-to-peak voltage Vpp and a wear variation of a surface layer of the photoreceptor.

With reference to FIG. 7, this Vpp margin table is substantially the same as the curve illustrated in FIG. 14 and illustrates the relationship between the variation of the film thickness (wear variation) and the estimated Vpp margin. A period within which the accumulated number of rotations of the photoreceptor 5 increases from a new state by 100 krot (a period during which the accumulated number of rotations is 0 to 100 krot) is defined as a first period, and the variation of the film thickness in this first period is assumed to be 3.5 μm. In this case, the estimated Vpp margin is estimated to be 150 V using the Vpp margin table as indicated by a point P1. As a result, the offset amount Vf to be employed after the first period is set to 75 V (=estimated Vpp margin×50%).

After the offset amount Vf is set to 75 V after the first period, a period within Which the accumulated number of rotations of the photoreceptor 5 increases by 100 krot (a period during which the accumulated number of rotations is 100 to 200 krot) is defined as a second period, and the variation of the film thickness in this second period is assumed to be 3 μm. In this case, the estimated Vpp margin is estimated to be 78 V using the Vpp margin table as indicated by a point P2. As a result, the offset amount Vf to be employed after the second period is set to 39 V (=estimated Vpp margin×50%).

After the offset amount is set to 39 V after the second period, a period within which the accumulated number of rotations of the photoreceptor 5 increases by 100 krot (a period during which the accumulated number of rotations is 200 to 300 krot) is defined as a third period, and the variation of the film thickness in this third period is assumed to be 2.8 μm. In this case, the estimated Vpp margin is estimated to be 38 V using the Vpp margin table as indicated by a point P3. As a result, the offset amount Vf to be employed after the third period is set to 19 V (estimated Vpp margin×50%).

After the offset amount Vf is set to 19 V after the third period, a period within which the accumulated number of rotations of the photoreceptor 5 increases by 100 krot (a period during which the accumulated number of rotations is 300 to 400 krot) is defined as a fourth period, and the variation of the film thickness in this fourth period is 2.6 μm (point P4). Thereafter, the offset amount Vf is repeatedly set until the variation of the film thickness becomes equal to or less than a threshold value TH1 indicating a normal wear variation.

Figure 8:
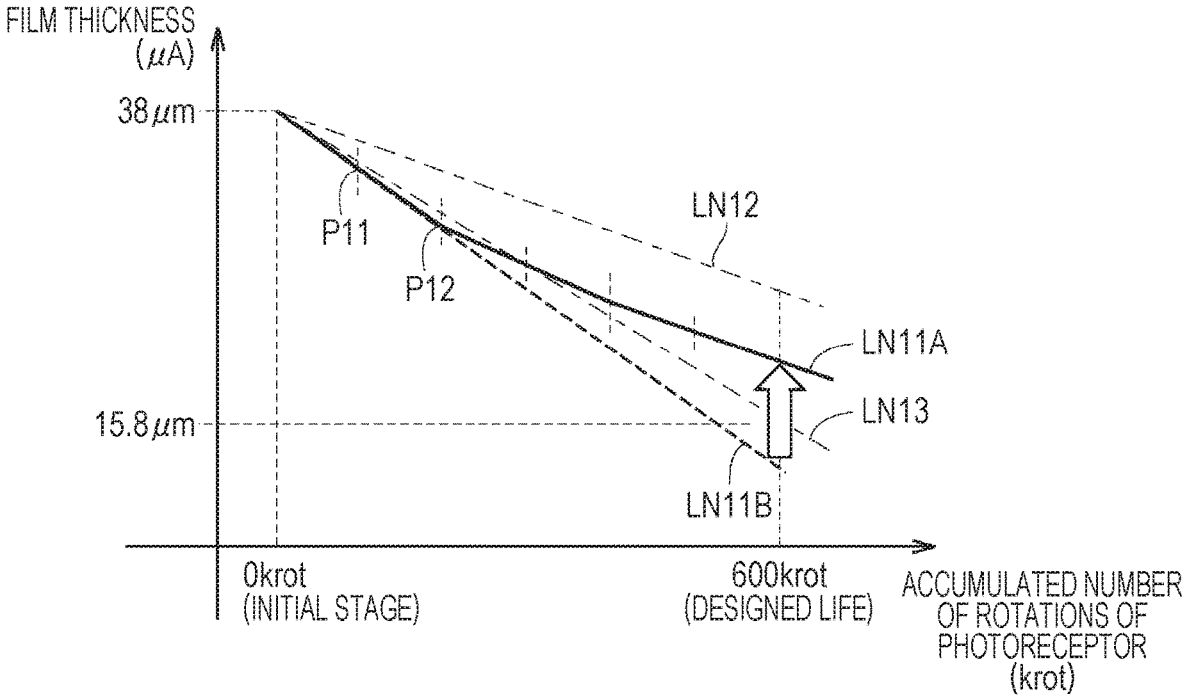
FIG. 8 is a graph schematically illustrating a variation of the film thickness of a surface layer of a photoreceptor as the accumulated number of rotations of the photoreceptor increases in the first embodiment of the present invention.

FIG. 8 is a graph schematically illustrating the variation of the film thickness of the surface layer 5*a* of the photoreceptor 5 as the accumulated number of rotations of the photoreceptor 5 increases in the first embodiment of the present invention. A line LN11A in FIG. 8 indicates the variation of the film thickness as the accumulated number of rotations of the photoreceptor 5 increases in the first embodiment of the present invention. A line LN11B in FIG. 8 indicates the variation of the film thickness as the accumulated number of rotations of the photoreceptor 5 increases when the control according to the first embodiment of the present invention is not performed. A line LN12 in FIG. 8 indicates the variation of the film thickness when the variation of the film thickness per the predetermined number of rotations is equal to the normal wear variation (threshold value TH1). A line LN13 in FIG. 8 indicates the variation of the film thickness when the variation of the film thickness per the predetermined number of rotations is equal to an upper limit (threshold value TH2) of the wear variation.

With reference to FIG. 8, according to the present embodiment, as indicated by the line LN11A, at a timing when the film thickness reaches the value indicated by a point P11, the deviation of variation of the film thickness from the line LN13 is small. Thus, the offset amount is not set. At the timing when the film thickness reaches a value indicated by s point P12, the variation of the film thickness increases and is deviated from the upper limit (line LN13) of the wear variation. Thus, the offset amount is set. Therefore, the wear rate of the film thickness becomes gentler than the upper limit of the wear variation (line LN13), as indicated by an arrow. As a result, it is possible to secure the minimum film thickness (15.8 m) required for operation at the time when the designed life of the photoreceptor 5 (accumulated number of rotations is 600 krot) ends.

On the other hand, when the control according to the present embodiment is not performed, as indicated by the line LN11B, the wear rate of the film thickness becomes faster than the upper limit (line LN13) of the wear variation. As a result, it is impossible to secure the minimum film thickness (15.8 μm) required for operation at the time when the designed life of the photoreceptor 5 (accumulated number of rotations of 600 krot) ends.

In the present: embodiment, when the variation of the film thickness of the surface layer 5*a* within a period within Which the photoreceptor 5 rotates a predetermined number of times deviates from the target value, the margin of the peak-to-peak voltage Vpp to be employed after the period is set based on the deviation amount. This can offset the margin of the peak-to-peak voltage Vpp in a direction to gradually decrease the margin within an appropriate range of the peak-to-peak voltage Vpp that does not affect the image quality. As a result, it is possible to prevent reduction of the life of the photoreceptor.

In addition, in the present embodiment, based on the actual variation of the film thickness in a certain period in a state where the peak-to-peak voltage Vpp set by any conventional method is employed, the excess and the deficiency of the margin added to the peak-to-peak voltage Vpp is determined to determine the offset amount. Therefore, it is unnecessary to consider whether the absolute value of the set peak-to-peak voltage Vpp is appropriate. Thus, it is possible to exclude influences such as variation of the initial film thickness, the resistance of the charging roller 6, or the performance of the power supply among individuals.

When the variation of the film thickness of the surface layer 5*a* within the second period is larger than the variation of the film thickness of the surface layer 5*a* estimated when the photoreceptor 5 has rotated a predetermined number of times in a state where the Vpp margin set after the first period is employed, the proportion of the offset amount set after the second period becomes larger. Thus, the offset amount can be adjusted according to the variation of the film thickness and change of the variation. As a result, it is possible to prevent occurrence of charging failure due to setting of an excessive offset amount.

Second Embodiment

In this embodiment, an example in which the control of setting the offset amount using feedback of the film thickness variation described in the first embodiment is performed only when a photoreceptor 5 is at a high temperature will be described. That is, a control unit 11 acquires a variation of the film thickness within a period within which a photoreceptor 5 rotates a predetermined number of times in a state where the temperature of the photoreceptor 5 is equal to or higher than a predetermined temperature reference value, and sets a margin of the peak-to-peak voltage Vpp to be employed when the temperature of the photoreceptor 5 is equal to or higher than the temperature reference value.

When an image with a high coverage rate is printed on both sides of a sheet or printed on a plurality of sheets continuously, the photoreceptor 5 is heated to a high temperature. When the photoreceptor 5 is at a high temperature, the discharge current amount between a charging roller 6 and the photoreceptor 5 increases, so that the influence of the margin added to the peak-to-peak voltage Vpp on the amount of wear of the photoreceptor 5 is large. In addition, when the photoreceptor 5 is at a high temperature, the discharge current amount is large, so that the detection accuracy of the Elm thickness based on the current value is high, Therefore, the control of setting the offset amount using feedback of the variation of the film thickness described in the first embodiment is particularly efficient when the photoreceptor 5 is at a high temperature.

Figure 9:
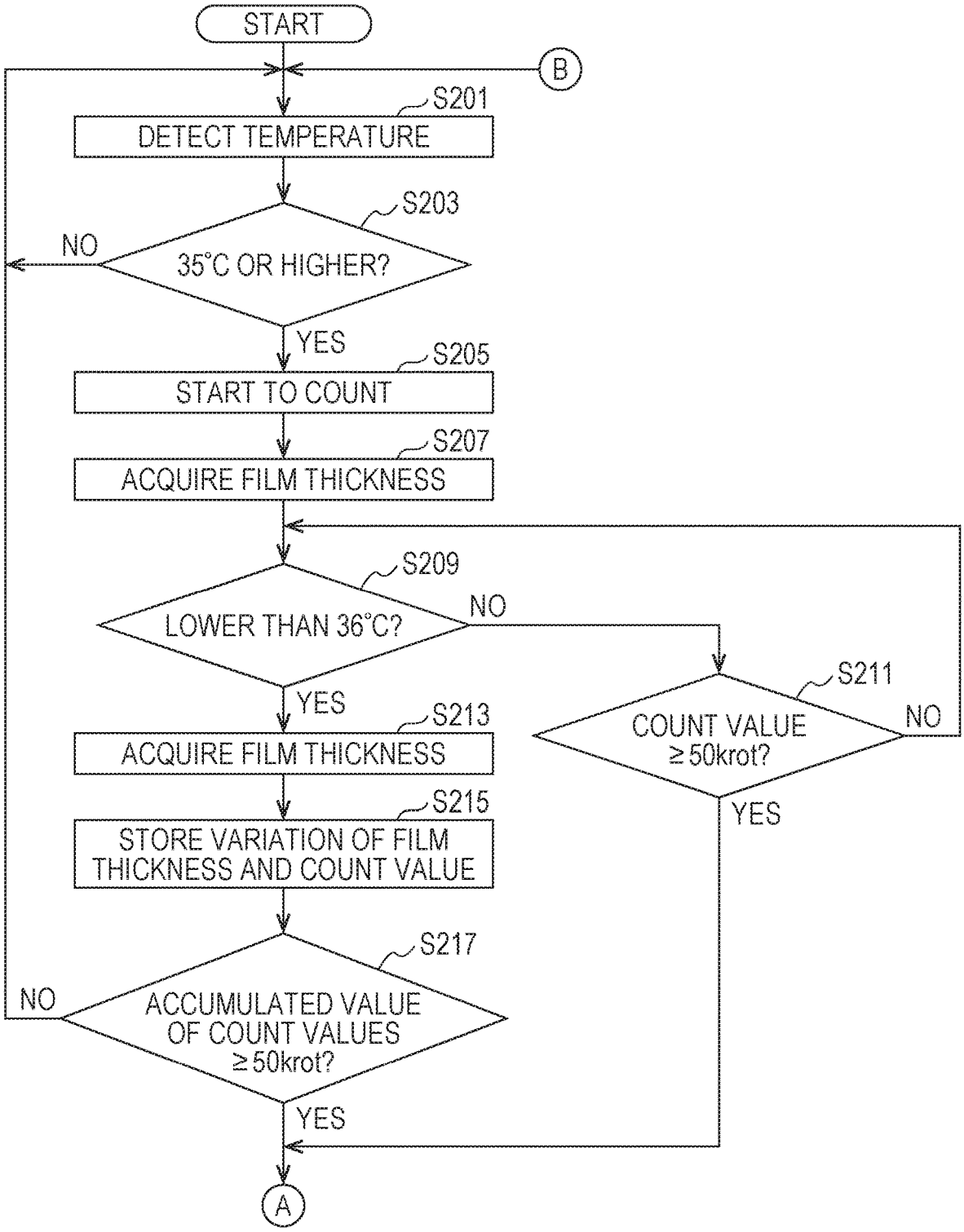
FIG. 9 illustrates a first portion of a flowchart of control executed by a control unit in a second embodiment of the present invention to control a peak-to-peak voltage Vpp of a charging voltage Vg to be applied to a charging roller.
Figure 10:
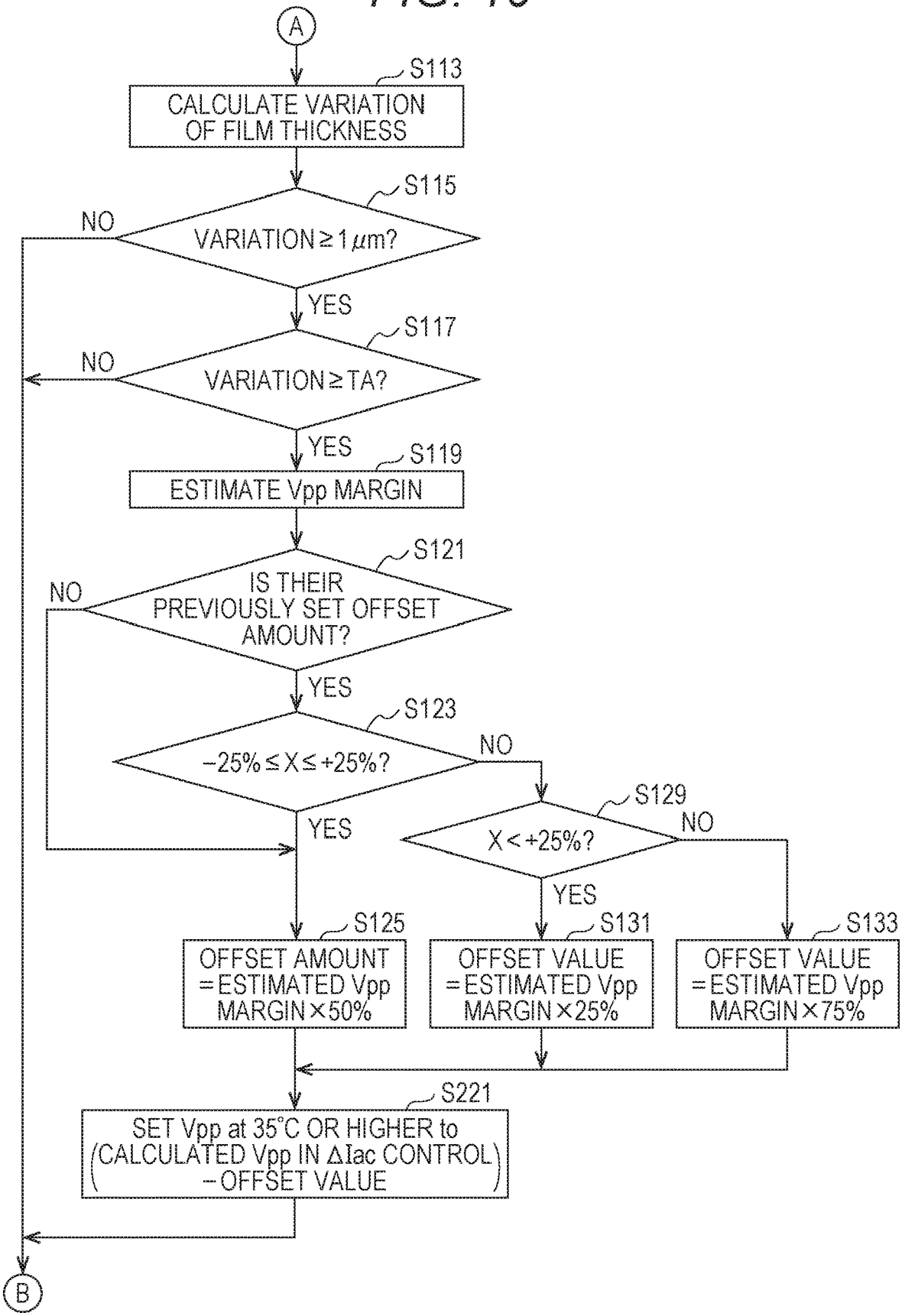
FIG. 10 illustrates a second portion of the flowchart of the control executed by the control unit in the second embodiment of the present invention to control the peak-to-peak voltage Vpp of the charging voltage Vg to be applied to the charging roller.

FIGS. 9 and 10 illustrate a flowchart of the control executed by the control unit 11 in the second embodiment of the present invention to control the peak-to-peak voltage Vpp of the charging voltage Vg to the applied to the charging roller 6. FIG. 9 corresponds to FIG. 5, and FIG. 10 corresponds to FIG. 6. The flowchart illustrated in FIGS. 9 and 10 is realized by a CPU 112 operating according to a control program stored in a ROM 111.

With reference to FIG. 9, the control unit 11 detects the temperature of the photoreceptor 5 at a predetermined timing (S201), and determines whether the detected temperature is 35° C. or higher (S203). Generally, the photoreceptor 5 is heated to a high temperature of 35° C. or higher when printing is performed on a certain number of sheets continuously.

If the control unit 11 determines in step S203 that the detected temperature is 35° C. or higher (YES in S203), the control unit 11 starts to count the number of rotations of the photoreceptor 5 from zero (S205), and acquires the film thickness of a surface layer 5*a* (S207), Subsequently, the control unit 11 determines whether the detected temperature of the photoreceptor 5 is cooled to lower than 36° C. (S209).

If the control unit 11 determines in step S209 that the detected temperature of the photoreceptor 5 is not lower than 36° C. (NO in step S209), the control unit 11 determines whether the count value of the number of rotations of the photoreceptor 5 is equal to or more than a predetermined number of rotations (S211).

In the present embodiment, it is assumed that the predetermined number of rotations is 50 krot. The predetermined number of rotations in the present embodiment is preferably smaller than the predetermined number of rotations in the first embodiment (100 krot). This is because when the photoreceptor 5 is at a high temperature, the wear variation is larger and accuracy of the film thickness based on the current value is high.

If the control unit 11 determines in step S211 that the count value of the number of rotations of the photoreceptor 5 is not equal to or more than the predetermined number of rotations (NO in S211), the control unit 11 proceeds to the processing in step S209.

If the control unit 11 determines in step S209 that the detected temperature of the photoreceptor 5 is cooled to lower than 36° C. (YES in step S209), the control unit 11 acquires the film thickness of the surface layer 5*a* (step S213). Next, the control unit 11 calculates the variation of the film thickness from the difference between the film thickness acquired in step S207 and the film thickness acquired in step S213, and stores the calculated variation in the storage unit 11*a* together with the count value of the number of rotations of the photoreceptor 5 at that time (S215). Next, based on the information stored in a storage unit 11*a*, the control unit 11 determines whether the accumulated value of the count values at a high temperature is equal to or more than the predetermined number of rotations (S217).

If the control unit 11 determines in step S203 that the detected temperature is not 35° C. or higher (NO in S203) or when the control unit 11 determines in step S217 that the accumulated value of the count values at a high temperature is not equal to or more than the predetermined number of rotations (in step S217 NO), the control unit 11 proceeds to the processing of step S201.

If the control unit 11 determines in step S211 that the count value of the number of rotations of the photoreceptor 5 is equal to or more than the predetermined number of rotations (YES in S211), or determines in step S217 that the accumulated value of the count values at a high temperature is equal to or more than the predetermined number of rotations (YES in S217), the control unit 11 proceeds to the processing of step S113 in FIG. 10.

With reference to FIG. 10, after setting the offset amount in steps S125, S131, or S133, the control unit 11 proceeds to the processing of step S221.

In step S221, the control unit 11 sets the peak-to-peak voltage Vpp of the charging voltage Vg to be actually applied to the charging roller 6 within a period of next 50 krot when the photoreceptor 5 is at a high temperature to a value obtained by subtracting the offset amount from the peak-to-peak voltage Vpp set in the ΔIac control (value V13 in FIG. 3) (S221). Thereafter, the control unit 11 proceeds to the processing of step S201 in FIG. 9.

Figures 11, 12:
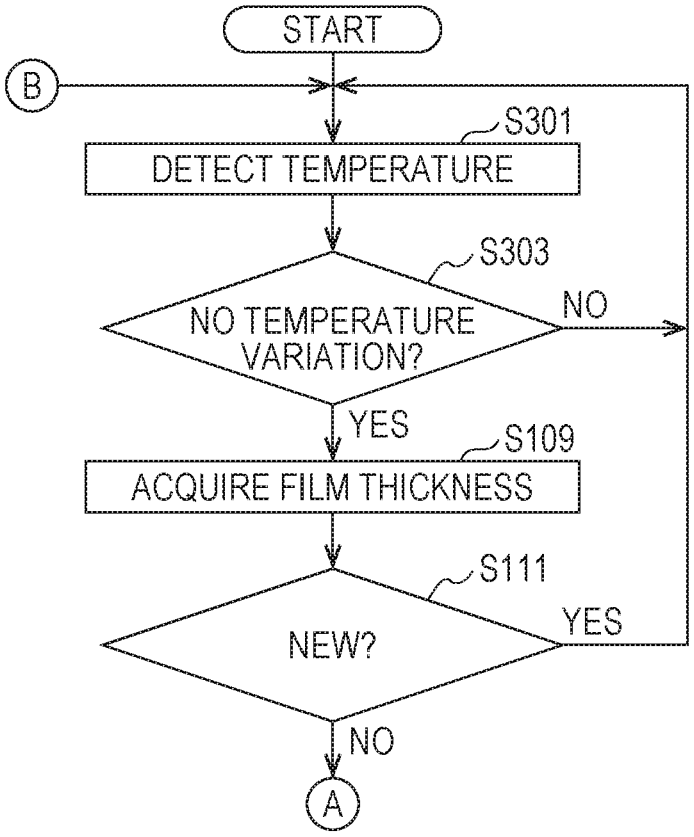
FIG. 11 is a diagram schematically illustrating information stored in a storage unit in the second embodiment of the present invention.
FIG. 12 is a flowchart relating to control performed by a control unit to set a peak-to-peak voltage Vpp of a charging voltage Vg applied to a charging roller in a third embodiment of the present invention.
Figure 13:
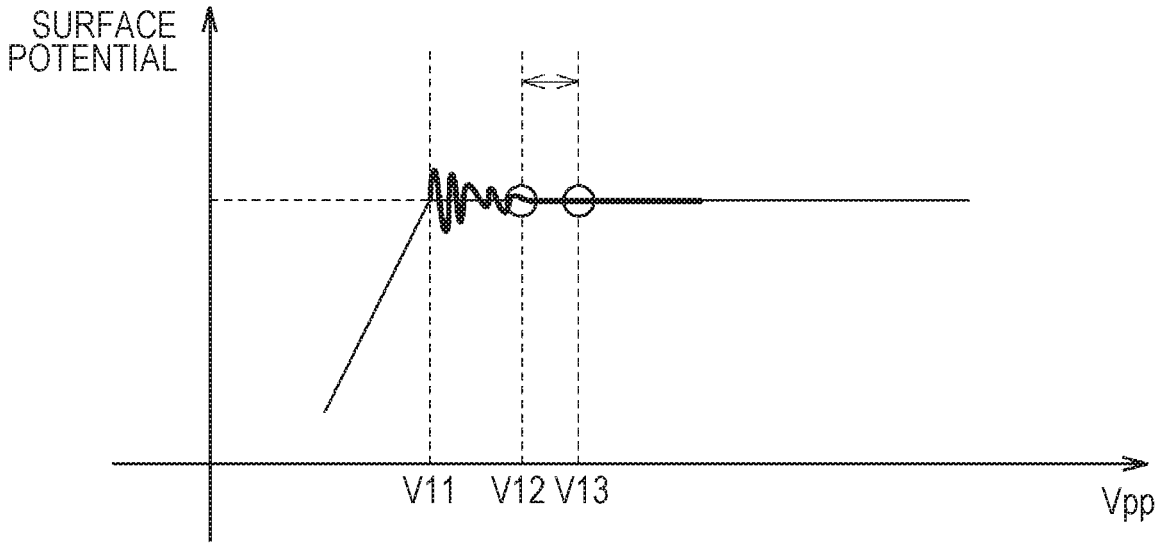
FIG. 13 is a graph illustrating a relationship between the peak-to-peak voltage Vpp and a surface potential of a photoreceptor.

FIG. 11 is a diagram schematically illustrating information stored in the storage unit 11*a* in the second embodiment of the present invention.

With reference to FIG. 11, in the present embodiment, every time an operation of the photoreceptor 5 at a high temperature ends (every time the photoreceptor 5 returns from the high temperature to the normal temperature), the rotation speed of the photoreceptor 5 at a high temperature and the variation of the film thickness of the surface layer 5*a* at the high temperature are stored in the storage unit 11*a*. At that time, the accumulated value of the numbers of rotations of the photoreceptor 5 at a high temperature and the accumulated value of the variation of the film thickness of the surface layer 5*a* at a high temperature are calculated (S215 in FIG. 9). In the information illustrated in FIG. 11, sets of values corresponding to three operations are stored. In the first operation at a high temperature, the photoreceptor 5 rotates only 6000 rot, and the film thickness of the surface layer 5*a* varies (wears) by only 0.20 μm. In the second operation at a high temperature, the photoreceptor 5 rotates 1050 rot, and the film thickness of the surface layer 5*a* varies (wears) by 0.04 μm. In the third operation at a high temperature, the photoreceptor 5 rotates 2600 rot, and the film thickness of the surface layer 5*a* varies (wears) by 0.15 μm. As a result, the accumulated value of the numbers of rotations of the photoreceptor 5 at a high temperature immediately after the third operation at a high temperature ends is 9650 rot, and the accumulated value of the variations of the film thickness of the surface layer 5*a* at a high temperature is 0.39 μm. The accumulated value of the variations of the film thickness corresponds to the variation of the film thickness calculated in S113 of FIG. 10.

The configuration and operations other than those described above of the image forming apparatus 1 are similar to those of the image funning apparatus according to the first embodiment, and thus description thereof will not be repeated.

According to the present embodiment, by performing the control of setting the offset amount using feedback of the variation of the film thickness only when the photoreceptor 5 is at a high temperature, the wear of the surface layer 5*a* when the photoreceptor 5 is used at a high temperature can be reduced while the side effect due to setting the offset amount is minimized.

Third Embodiment

In this embodiment, an example in which the control of setting the offset amount using feedback of the film thickness variation described in the first embodiment is performed only when the temperature variation of the photoreceptor 5 within a predetermined period is within a predetermined temperature variation will be described.

For example, an image forming apparatus that prints only a small amount per day in a stable environment that is air-conditioned can perform charging control with little influence by temperature variation. In this case, the accuracy of the charging control increases, while the life of the photoreceptor 5 also increases. Thus, the influence of the margin of the peak-to-peak voltage Vpp due to the initial variation of units and power supplies among the individuals on the film thickness of a surface layer 5*a* also increases. Therefore, the control of setting the offset amount using feedback of the variation of the film thickness described in the first embodiment is particularly efficient when the temperature variation of the photoreceptor 5 within a day is small.

FIG. 12 is a flowchart relating to control performed by a control unit 11 to set the peak-to-peak voltage Vpp of the charging voltage Vg applied to the charging roller 6 in the third embodiment of the present invention. FIG. 12 corresponds to FIG. 5. The flowchart illustrated in FIG. 12 is realized by a CPU 112 operating according to the control program stored in a ROM 111.

With reference to FIG. 12, a control unit 11 detects the temperature of the photoreceptor 5 at a predetermined timing (S301), and determines whether the temperature variation of the photoreceptor 5 within a day excluding early morning is within a predetermined range (for example, ±5° C. or less) (S303).

If the control unit 11 determines in step S303 that the temperature variation of the photoreceptor 5 within one day excluding early morning is within the predetermined range (YES in step S303), the control unit 11 performs the control of setting the offset amount using feedback of the variation of the film thickness described in the first embodiment (sets the margin of the peak-to-peak voltage Vpp to be employed). In this case, the control unit 11 performs the processing of step S109 and following steps in FIG. 5.

If the control unit 11 determines in step S303 that the temperature variation of the photoreceptor 5 within one day excluding early morning is out of the predetermined range (NO in step S303), the control unit 11 suspends the control of setting the offset amount using feedback of the variation of the film thickness described in the first embodiment temporarily. In this case, the control unit 11 proceeds to the processing of step S301. The control unit 11 employs the previous offset amount when the temperature variation of the photoreceptor 5 within a day excluding early morning comes to be within the predetermined range, so that the control unit 11 restarts the control of setting the offset amount using feedback of the variation of the film thickness described in the first embodiment.

The configuration and operations other than those described above of the image firming apparatus 1 are similar to those of the image forming apparatus according to the first embodiment, and thus description thereof will not be repeated.

According to the present embodiment, by performing the control of setting the offset amount using feedback of the variation of the film thickness only when the temperature variation of the photoreceptor 5 within a day is small, the wear of the surface layer 5*a* can be reduced while the side effect due to setting the offset amount is minimized.

Other Variations

In the above-described embodiments, the peak-to-peak voltage Vpp of the AC voltage of the charging voltage applied to the charging roller 6 is taken as an example of a parameter related to the control of the photoreceptor 5 as an object of setting the margin. In addition to the peak-to-peak voltage Vpp, the parameter related to the control of the photoreceptor 5 for which the margin is set may be the contact pressure of the cleaning blade for cleaning the photoreceptor, the difference between the rotation speeds of the intermediate transfer belt 3 and the photoreceptor 5 (circumferential speed difference), or the like.

With reference to FIG. 1, when the image forming apparatus 1 is a color printing machine, the temperature rise levels differ between the photoreceptors 5 of respective colors. Therefore, the timing (the number of rotations, or the period) at which the variations of the film thicknesses of the surface layers 5*a* of the photoreceptors 5 of respective colors are acquired may be different from each other. Normally, the temperature of the photoreceptor 5 of color of K that is the closest to the fixing device 80 tends to rise as compared with the photoreceptors 5 of respective colors of Y, M, and C. Therefore, by setting the timing of acquiring the variation of the film thickness of the photoreceptor 5 of color of K, for example, to a timing when the number of rotations has increased by 80 krot, so that the variation of the film thickness of the photoreceptor 5 of color of K is acquired more frequently than the acquisition of variations of the film thicknesses of the photoreceptors 5 of respective colors of Y, M, and C (at a timing when the number of rotations has increased by 100 krot).

With reference to FIGS. 1 and 4, when an abnormal situation occurs such as a crack is found on the photoreceptor 5 or a measurement value of the environment detection unit 12 indicates abnormality, the control unit 11 cannot appropriately set offset amounts for parameters related to control of the photoreceptor. In such a situation, it is desirable that a user or a serviceman can manually change the offset amount or stops the setting of the offset amount itself through an operation panel 90 (an example of an acceptor). When the control unit 11 accepts an operation relating to the control of the photoreceptor 5 through the operation panel 90, the control unit 11 performs control to reset the margin of the peak-to-peak voltage Vpp to the initial value or change the margin according to the operation accepted through the operation panel 90 regardless of the margin (offset amount) of the set peak-to-peak voltage Vpp having been set. Thus, it is possible to prevent fatal troubles caused by abnormal situations.

The above-described embodiments can be combined as appropriate.

The processing of the above-described embodiments may be performed by software or may be performed using a hardware circuit. Further, it is also possible to provide a program for performing the processing in the above-described embodiments, and the program may be recorded on a recording medium such as a CD-ROM, a flexible disk, a hard disk, a ROM, a RAM, and a memory card, and provided to a user. The program is executed by a computer such as a CPU. Further, the program may be downloaded to the apparatus via a communication line such as the Internet.

Although embodiments of the present invention have been described and illustrated in detail, the disclosed embodiments are made for purposes of illustration and example only and not limitation. The scope of the present invention should be interpreted by terms of the appended claims, and it is intended that the scope of the present invention covers all modifications within meaning and scope equivalent to the claims.

What is claimed is:

1. An image forming apparatus comprising:

a photoreceptor including a surface layer;

a storage that stores a target value of a variation of a film thickness of the surface layer; and a hardware processor that:

acquires a variation of the film thickness in a first period within which the photoreceptor rotates a predetermined number of times, and sets a margin that is an amount of a portion for allowance with respect to a proper value of a parameter related to control of the photoreceptor, based on a deviation of the acquired variation of the film thickness in the first period from the target value of the variation of the film thickness, the margin being a margin to be employed after the first period.

2. The image forming apparatus according to claim 1, further comprising:

a charging roller that charges the photoreceptor, wherein the parameter is a peak-to-peak voltage of an AC component of a charging voltage applied to the charging roller.

3. The image forming apparatus according to claim 1, wherein:

the storage further stores information indicating a relationship between the variation of the film thickness and the margin, the target value is an estimated variation of the film thickness when the photoreceptor rotates the predetermined number of times in a state where the parameter is set to the proper value, the hardware processor estimates the margin having been employed in the first period based on the variation acquired by the hardware processor and the information, and the hardware processor sets the margin to be employed after the first period based on the margin estimated by the hardware processor.

4. The image forming apparatus according to claim 3, wherein when the variation of the film thickness acquired by the hardware processor is larger than the target value, the hardware processor sets the margin to be employed after the first period to a value smaller than the margin estimated by the hardware processor.

5. The image forming apparatus according to claim 4, wherein when the variation of the film thickness acquired by the hardware processor is larger than the target value, the hardware processor sets the margin to be employed after the first period to a value obtained by subtracting an offset amount from the margin, the offset amount being a necessary proportion of the margin estimated by the hardware processor.

6. The image forming apparatus according to claim 3, wherein when the variation of the film thickness acquired by the hardware processor is smaller than the target value, the hardware processor sets the margin to be employed after the first period to a value equal to the margin estimated by the hardware processor.

7. The image forming apparatus according to claim 1, wherein:

the hardware processor acquires a variation of the film thickness in a second period within which the photoreceptor rotates the predetermined number of times with the parameter set by the hardware processor, the hardware processor sets a margin to be employed after the second period to a value obtained by subtracting an offset amount that is a necessary portion of the margin having been employed in the second period from the margin having been employed in the second period in a case where the variation of the film thickness acquired by the hardware processor is larger than a predetermined range of film thickness variation including the target value, and the hardware processor sets the portion of the offset to be larger when the variation of the film thickness acquired by the hardware processor is larger than an estimated variation of the film thickness in a case where the photoreceptor rotates the predetermined number of times in a state where the margin set by the hardware processor is employed.

8. The image forming apparatus according to claim 1, wherein:

the hardware processor acquires the variation of the film thickness based on a relationship between a charging voltage to be applied to a charging roller that charges the photoreceptor and a current flowing through the photoreceptor by the charging voltage, and when an accumulated number of rotations of the photoreceptor is larger than a predetermined reference number of rotations, the hardware processor sets a peak-to-peak voltage of an AC component of the charging voltage to be applied to the charging roller to be lower as compared to a case where the accumulated number of rotations of the photoreceptor is smaller than the predetermined reference number of rotations.

9. The image forming apparatus according to claim 1, wherein:

the hardware processor acquires the variation of the film thickness in the first period within which the photoreceptor rotates the predetermined number of times in a state where a temperature of the photoreceptor is equal to or higher than a predetermined temperature reference value, and the hardware processor sets the margin to be employed when the temperature of the photoreceptor is equal to or higher than the temperature reference value.

10. The image forming apparatus according to claim 1, wherein:

the hardware processor acquires the variation of the film thickness in the first period when a temperature variation of the photoreceptor within a predetermined period is within a predetermined temperature variation range, and the hardware processor sets the margin to be employed when the temperature variation of the photoreceptor is within the temperature variation range.

11. The image forming apparatus according to claim 1, wherein:

the photoreceptor includes a plurality of photoreceptors carrying toner images of different colors from each other, the hardware processor acquires the variation of the film thickness of each of the plurality of photoreceptors, and the first periods each defining a timing for acquiring the variation of the film thickness of each of the plurality of photoreceptors are different from each other.

12. The image forming apparatus according to claim 1, wherein:

the hardware processor accepts an operation related to control of the photoreceptor, and the hardware processor resets the margin to an initial value or changes the margin in accordance with the operation.

13. A method for controlling an image forming apparatus including a photoreceptor including a surface layer, and a storage that stores a target value of a variation of a film thickness of the surface layer, the method comprising:

acquiring a variation of the film thickness in a first period within which the photoreceptor rotates a predetermined number of times; and setting a margin that is an amount of a portion for allowance with respect to a proper value of a parameter related to control of the photoreceptor, based on a deviation of the acquired variation of the film thickness in the first period from the target value of the variation of the film thickness, the margin being a margin to be employed after the first period.

* * * * *